US006125565A

United States Patent [19]

Hillstrom

[11] Patent Number: 6,125,565

[45] **Date of Patent: *Oct. 3, 2000**

[54] OUTDOOR MENU DISPLAY DEVICE

[75] Inventor: David U. Hillstrom, Novi, Mich.

[73] Assignee: Marketing Displays, Inc., Farmington Hills, Mich.

[ * ] Notice: This patent is subject to a terminal disclaimer.

[21] Appl. No.: 09/283,069

[22] Filed: Mar. 31, 1999

Related U.S. Application Data

[63] Continuation of application No. 08/893,603, Jul. 14, 1997, which is a continuation-in-part of application No. 08/702,101, Aug. 23, 1996, Pat. No. 5,682,694, which is a continuation of application No. 08/317,690, Oct. 5, 1994, abandoned.

[51] Int. Cl.[7] ..... G09F 13/04

[52] U.S. Cl. ..... 40/574; 40/576; 40/568

[58] Field of Search ..... 40/574, 576, 564, 40/568, 585, 605, 607, 611; 312/139; 362/362, 812

[56] References Cited

U.S. PATENT DOCUMENTS

| | | | |
|---|---|---|---|
| D. 279,585 | 7/1985 | Seggerson et al. | D20/10 |
| D. 279,587 | 7/1985 | Seggerson et al. | D20/42 |
| 1,120,876 | 12/1914 | Witz . | |
| 1,447,918 | 3/1923 | Zacher . | |
| 1,747,400 | 2/1930 | Stewart et al. . | |
| 1,809,804 | 6/1931 | Rider . | |
| 1,834,423 | 12/1931 | Rider | 40/585 |
| 2,515,664 | 7/1950 | Padgett . | |
| 2,547,049 | 4/1951 | Seep . | |
| 3,310,901 | 3/1967 | Sarkisian . | |
| 3,601,917 | 8/1971 | Shankman . | |
| 3,650,055 | 3/1972 | Bult, III . | |
| 3,673,720 | 7/1972 | Thornton . | |
| 3,905,139 | 9/1975 | Cooper . | |
| 3,939,584 | 2/1976 | Trame . | |
| 4,048,738 | 9/1977 | McHenry . | |
| 4,095,359 | 6/1978 | Trame | 40/446 |

(List continued on next page.)

FOREIGN PATENT DOCUMENTS

| | | | |
|---|---|---|---|
| 750111 | 1/1967 | Canada | 40/574 |
| 3313914 | 10/1984 | Germany . | |
| 651180 | 1/1963 | Italy . | |
| 24774 | 6/1911 | United Kingdom | 40/574 |

OTHER PUBLICATIONS

Brochure: "Panel–Lite Menu Board Series", American Menu Displays (date not given).

(List continued on next page.)

*Primary Examiner*—Joanne Silbermann

[57] ABSTRACT

An improved outdoor illuminated display device. The device generally comprises a modular housing, a base member and a plurality of lights positioned in the housing—either horizontally or vertically. A plurality of display modules are positioned on the housing and backlit by the lights. A door member is pivotally connected along its upper edge to the housing covering the modules. A pair of gas-assisted spring members are provided between the door member and the housing. Air gaps or air vents are provided in order to allow air circulation in the housing. A second member above the door member is provided for holding and displaying posters and other advertising and promotional materials. A plurality of clamping members hold the display materials in place. The second member can be illuminated or non-illuminated. Various modular units can be provided to increase the size and display space provided by the device. The display modules include a plurality of horizontal divider members removably secured to retainer members. Menu strips, pricing units and display members can be positioned between channels in the divider members and/or the frame members forming the display modules. The pricing units are adapted to be backlit by lights in the display device.

11 Claims, 13 Drawing Sheets

U.S. PATENT DOCUMENTS

| | | | |
|---|---|---|---|
| 4,145,828 | 3/1979 | Hillstrom . | |
| 4,292,752 | 10/1981 | Clark | 40/576 |
| 4,364,616 | 12/1982 | Harkins et al. | 312/223 |
| 4,521,984 | 6/1985 | Murray | 40/576 |
| 4,653,209 | 3/1987 | Cobb | 40/618 |
| 4,693,026 | 9/1987 | Callahan et al. | 40/576 |
| 4,753,026 | 6/1988 | Woodman et al. | 40/584 |
| 4,802,296 | 2/1989 | Kovalak, Jr. | 40/607 |
| 4,817,316 | 4/1989 | Walker | 40/576 |
| 5,029,406 | 7/1991 | Hofman | 40/488 |
| 5,044,104 | 9/1991 | Hopperdietzel . | |
| 5,088,221 | 2/1992 | Bussiere et al. | 40/618 |
| 5,207,490 | 5/1993 | Kaspar et al. | 312/139 |
| 5,241,467 | 8/1993 | Failing et al. . | |
| 5,263,269 | 11/1993 | Tjarnlund | 40/649 X |
| 5,636,463 | 6/1997 | Sharon et al. | 40/618 |
| 5,682,694 | 11/1997 | Hillstrom | 40/574 |
| 5,983,543 | 11/1999 | Hillstrom | 40/574 |

OTHER PUBLICATIONS

Brochure: "Designer Series panel–lite Radius Menu Boards", American Menu Displays (date not given).

Brochure: "Panelon Menuboard system", Posterloid Corporation, 1983.

MDI Design File: "McDonald's" Menuboard Topper, #64, Oct. 1989.

Brochure: "Point of Purchase Products", International Patterns Incorporated, 1993.

Brochure: "Black Vista Illuminated Menuboards", Posterloid Corporation, 1981.

Brochure: "KFC", Wolfe Merchandising.

Brochure: "Outdoor Illuminated Menu System", Mainstreet Menu Systems, 1990.

Brochure: "Illuminated Menu System", Mainstreet Menu Systems, Jan. 1988.

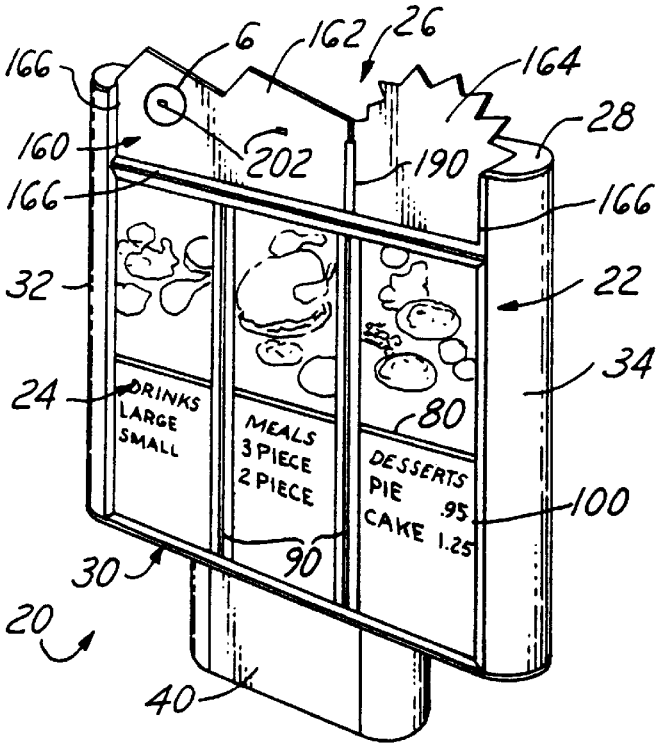
FIG. 1
FIG. 11
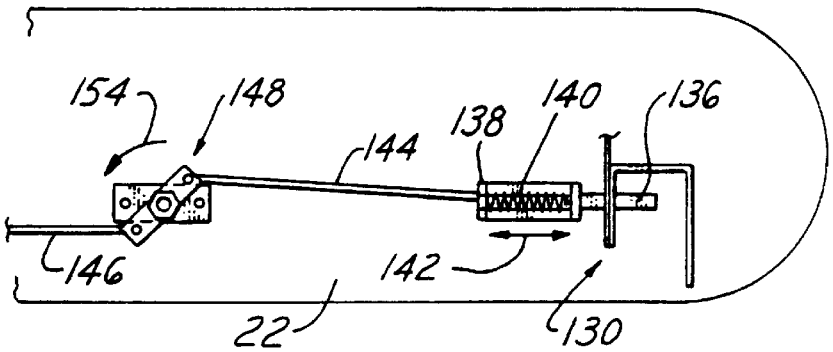
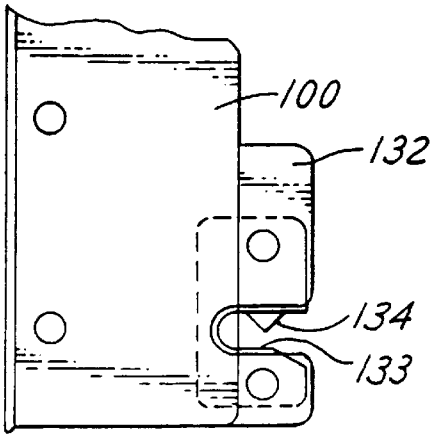
FIG. 3A

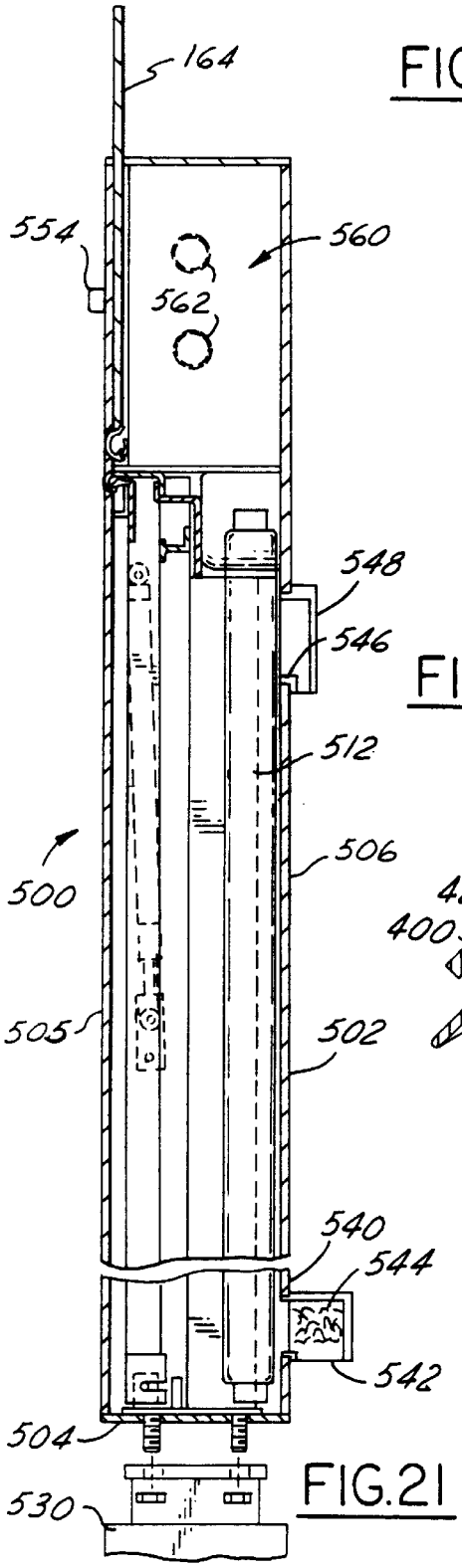
FIG.21
FIG.22
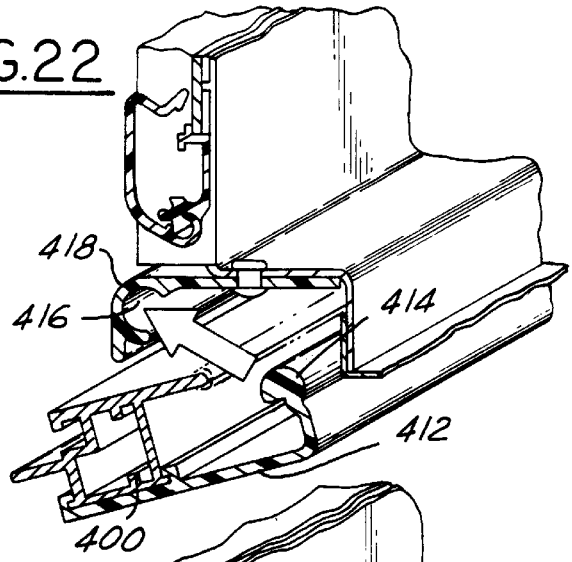
FIG.23
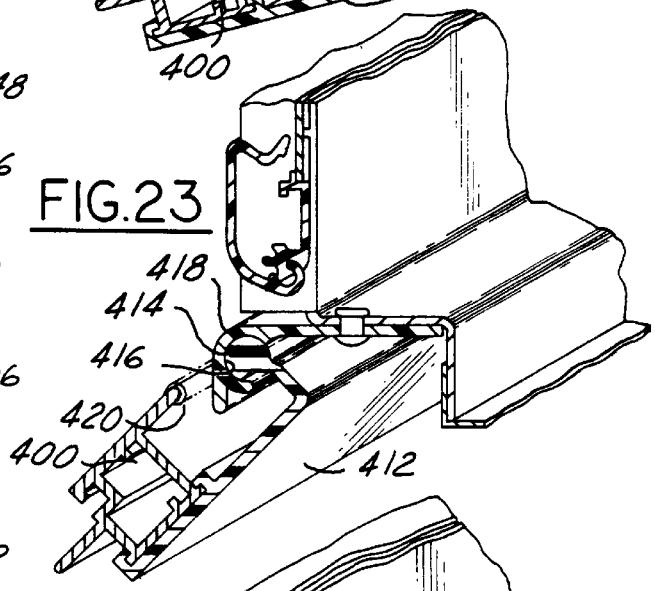
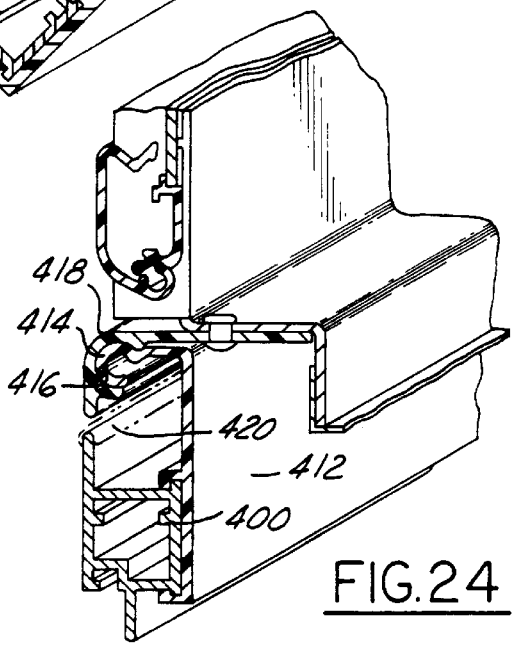
FIG.24

OUTDOOR MENU DISPLAY DEVICE

CROSS-REFERENCE TO RELATED APPLICATIONS

This application is a continuation of application(s) Ser. No. 08/893,603 filed on Jul. 14, 1997 U.S. Pat. No. 5,983,543 which in turn is a continuation-in-part of application Ser. No. 08/702,101, filed on Aug. 23, 1996, now U.S. Pat. No. 5,682,694, issued Nov. 4, 1997 which in turn is a continuation of Ser. No. 08/317,690, filed Oct. 5, 1994 now abandoned.

TECHNICAL FIELD

This invention relates to illuminated display devices which include one or more housings, interior lights, and translucent panels for presentation of a backlit advertisement or promotional item, particularly for outdoor environments.

BACKGROUND ART

Illuminated outdoor signs and display devices are commonly in use for many purposes today, particularly for presenting advertising and promotional materials relative to various businesses. Fast-food restaurants in particular use illuminated signs on their premises adjacent pathways leading to the restaurant or along their vehicle drive-through service lanes. The devices are used to display various menu items and/or to provide information and prices for consumers. In addition, the marketing of "specials" are often promoted by these devices.

Restaurants and other businesses utilize a number of various types of signs, both lighted and unlighted, and both indoors and outdoors, for promotion of their goods and services. These signs are often lighted for nighttime viewing, either in the front by flood lights or overhead lighting, or from the back through transparent panels. These types of signs have various concerns and problems relative to providing devices which are economical, aesthetic and durable. When used outdoors, the displays must also be able to withstand environmental conditions, such as wind, rain, snow, sun, freezing temperatures and elevated temperatures, and still maintain their integrity and usefulness for their intended purposes.

Outdoor sign devices which have enclosed housings with transparent members covering and protecting the promotional materials, often have condensation and moisture problems. Moisture which enters the device or is created by condensation is often difficult to remove and frequently adversely affects the aesthetics and visibility of the displays. Lighted signs, particularly those that are internally backlit, often have an increased problem from moisture and condensation due to the heat generated by the lights. The lights also can accentuate any distortions or warping of the advertising materials, creating additional concerns.

It is also important with outdoor signs that security procedures of some type be taken so that the messages and pricing materials on the signs cannot be tampered with or vandalized. At the same time, it is also necessary to allow frequent and easy access to the displays by authorized personnel in order to change the promotional items or add additional current items. Further, it is of interest to businesses to include additional advertising and promotional posters and items on the device housings to advertise and promote "specials" or other current matters.

It is an object of the present invention to provide improved outdoor illuminated sign devices, particularly for holding and displaying advertising and promotional materials. It is another object of the present invention to provide illuminated sign devices which create airflows inside the structure to minimize or prevent moisture and condensation problems, and to minimize heat build-up.

It is an additional object of the present invention to provide illuminated devices which have transparent doors on the front for protecting advertising and promotional materials from environmental elements and for preventing unauthorized or inadvertent access to the materials. At the same time, it is an object of the present invention to provide illuminated devices which are readily accessible by authorized personnel to change, remove or add to the displayed materials.

It is a still further object of the invention to provide illuminated devices which have one or more areas or portions for presentation of price and menu items behind a transparent door, and other areas or portions for direct display of posters and other displays.

Other objects of the present invention include providing a more stable illuminated sign system, providing a modular sign system which allows flexibility in the size and display of the advertising portions, and providing unique backlit display modules for displaying prices and menu items inside illuminated sign devices.

These and other objects, features, benefits and advantages of the present invention will become apparent when the following description of the invention is viewed in accordance with the attached drawings and appended claims.

SUMMARY OF THE INVENTION

The present invention provides illuminated display devices which are improvements over known illuminated display devices. An enclosed housing containing a plurality of lights, particularly fluorescent lights, has a first area or portion with a transparent cover for placement of the pricing, advertising and promotional materials, and a second display area or portion for additional posters and displays. The first area is typically divided into a number of sections, each section displaying a separate advertising or promotional material or a menu board with prices thereon. The pricing members preferably have the ability to be changed quickly and easily. The materials in the second area are held in place by clamping members positioned around one or more edges of the display materials and by extrusions with display channels.

A transparent door is provided on the front of the device to protect the advertising and promotional materials in the first area from the elements and also from vandalism. A frame is provided around the perimeter of the door made from extrusion members. The door is hinged to the housing along its upper edge. A latching mechanism is utilized to secure the door to the housing when it is closed. A latching/unlatching mechanism, preferably hidden from view of customers, allows the door to be opened for change of the messages on the surface of the menu and display board. A pair of gas-assisted springs positioned between the door and the housing permit the door to be opened and closed in an efficient manner.

A space or gap can be provided around the perimeter of the door of the display device to allow air to flow between the door and the menu and display materials. Alternatively, the door can be sealed against the display device and one or more vents provided in the back of the device in order to allow circulation of air and venting of any hot air build up inside the device. The menu and display portion of the housing allows quick and easy change of the advertising and menu sections. A plurality of lights, such as vertical or horizontal fluorescent lights positioned in the housing provide light through the advertising and menu displays in order to make them visible to the public. In this regard, the advertising and promotional materials, as well as the members forming the price and menu signage, are at least partially transparent or translucent in order to allow the light from the fluorescent lamps to pass through them.

The two outer sides of the housing can be provided with rounded extrusions. These extrusions are adapted to blend with the door member when the door member is closed in order to provide a smooth appearance without any sharp angles or corners.

Alternatively, the sign device can have a plurality of modular members which are adapted to be secured to the sides or top of the display device to increase the advertising and promotional size and value of the device.

The second area or portion for display of advertising and promotional materials is provided adjacent the upper edge of the door member. This second area can be non-unilluminated or backlit for better effect at night or in other lowlight conditions. Clamping members are provided along one or more edges of these display sections. Also, one or more channel extrusion members can be provided in the area to divide it into separate areas for display of separate advertising and promotional materials. The clamping members and extrusions can hold advertising and promotional materials in an upright manner and allow them to extend above the upper surface of the housing. If desired, additional securing mechanisms can be provided to help hold the display materials in place.

The menu boards for the display can comprise backlit modular members having a frame with a plurality of horizontal track members positioned therein. The track members preferably have elongated slots or channels for holding display materials (prices, menu items, etc.) and are releasably retained in the frame by retention members. The slots or channels can be overlapped and ramp areas can be provided to assist in positioning display materials between adjacent track members.

BRIEF DESCRIPTION OF THE DRAWINGS

FIG. 1 is a perspective view of an illuminated lightbox device in accordance with the present invention;

FIG. 3A depicts a latching member used with the present invention and as indicated by the circle 3A in FIG. 3;

FIG. 11 is a partial cross-sectional view taken along lines 11—11 in FIG. 10 and in the direction of the arrows;

FIG. 21 is a cross-sectional view of the lightbox device shown in FIG. 19, the cross-section being taken along line 21—21 in FIG. 19 and in the direction of the arrows;

FIGS. 22–24 are enlarged, perspective, partial cross-sectional views depicting a second hinging mechanism for the door member in accordance with the present invention;

BEST MODE(S) FOR CARRYING OUT THE INVENTION

Figure 2:
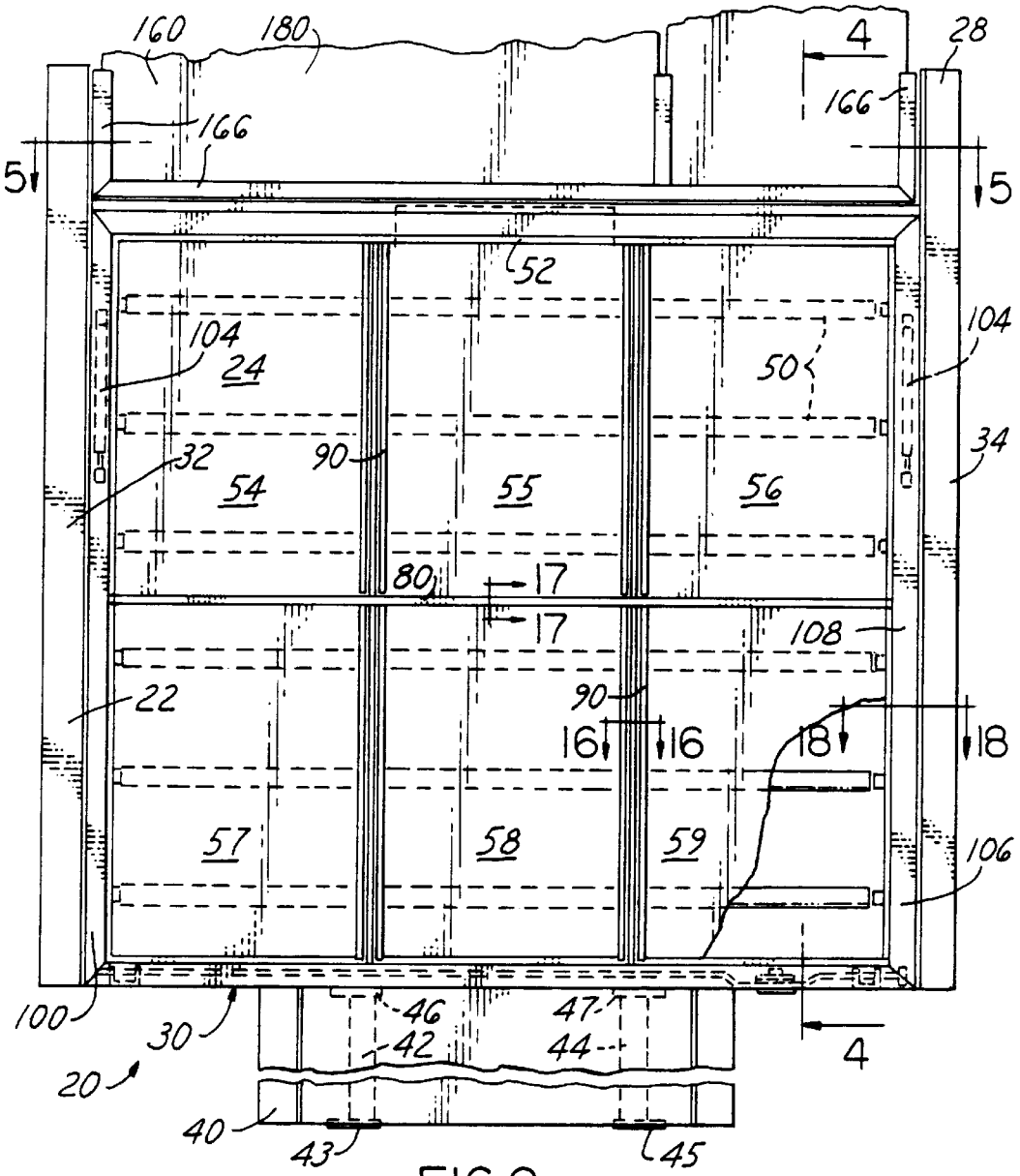
FIG. 2 is a front elevational view of the illuminated lightbox device as shown in FIG. 1.

One preferred embodiment of the present invention is depicted and illustrated in FIGS. 1–18 of the drawings. The illuminated lightbox or display device is referred generally by the reference numeral 20.

Figure 3:
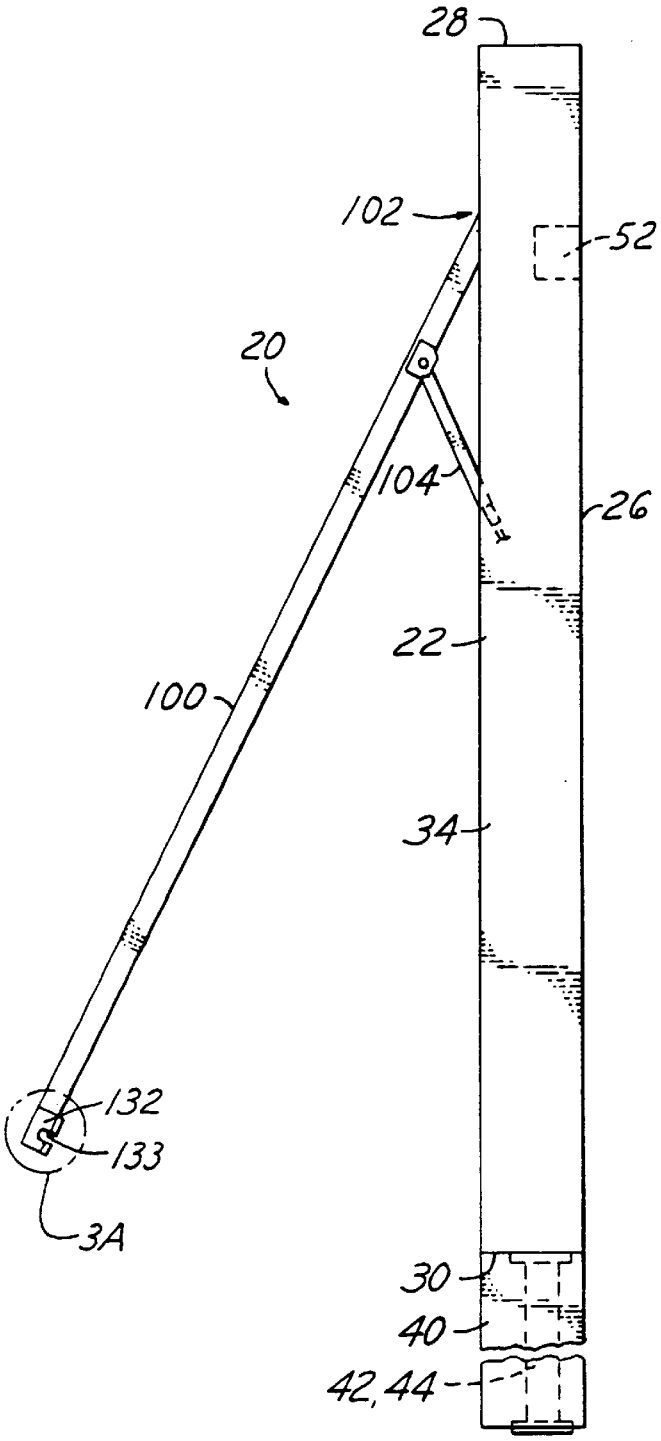
FIG. 3 is a side elevational view of the illuminated lightbox device.
Figure 4:
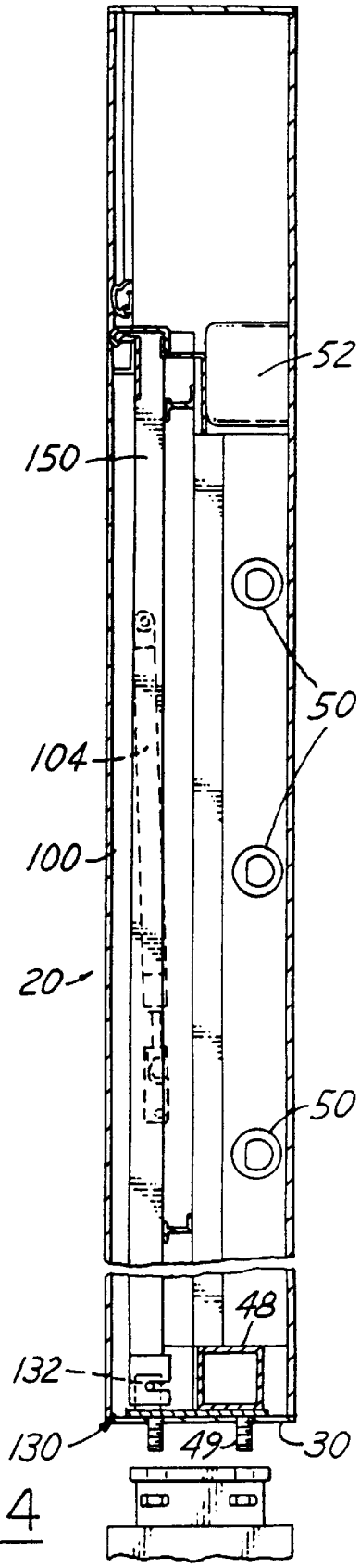
FIG. 4 is a cross-sectional view of the lightbox device of FIG. 1 when taken along lines 4—4 in FIG. 2 and in the direction of the arrows.
Figure 6:
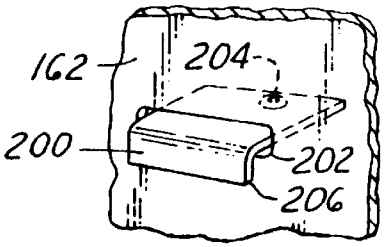
FIG. 6 depicts a spring clip utilized with the present invention as indicated by the circle 6 in FIG. 1.

FIGS. 1–3 depict the size, shape and configuration of the illuminated display device 20. The present invention preferably has use as an outdoor illuminated sign box device at drive-through lanes at fast-food restaurants. It is understood, however, that the illuminated device in accordance with the present invention can be used for other purposes and in other environments, such as indoors.

As illustrated, the device 20 includes a housing 22 which has a front surface 24, a rear surface 26, an upper surface 28, a lower surface 30 and two side surfaces 32 and 34. The housing is attached to a base 40.

The base 40 is comprised of a series of aluminum panel members formed in the configuration shown and which surround a pair of steel pedestals 42 and 44. The pedestals 42,44 are attached to base plates 43 and 45 which are secured in any conventional manner, such as by bolts or other fasteners, to a concrete base footing or the like (not shown). The pedestals 42,44 also have plates 46,47 at their upper ends which are attached to a torsional tubular member 48 in the lower portion of the housing 22. The tubular member 48 is attached to the lower surface or panel member 30 of the housing and in turn connected to the plates 46,47 by bolts or other conventional fastening means.

The two side surfaces or members 32,34 of the housing 22 also have a shape and configuration which matches that of the base cabinet 40. In this regard, the side members 32,34 are made from aluminum extrusions formed in a rounded or bullnosed shape. Not only does the rounded shape of the sides provide a pleasing and aesthetic configuration for the device 20, but it also provides for a smooth transition from the side surfaces to the front and rear members 24,26 without sharp angles or corners.

The rear surface or member 26 of the housing is a panel of aluminum sheet material. It is connected to the extruded side members 32,34 by rivets or other conventional fasteners 27 (see FIG. 5).

Figure 18:
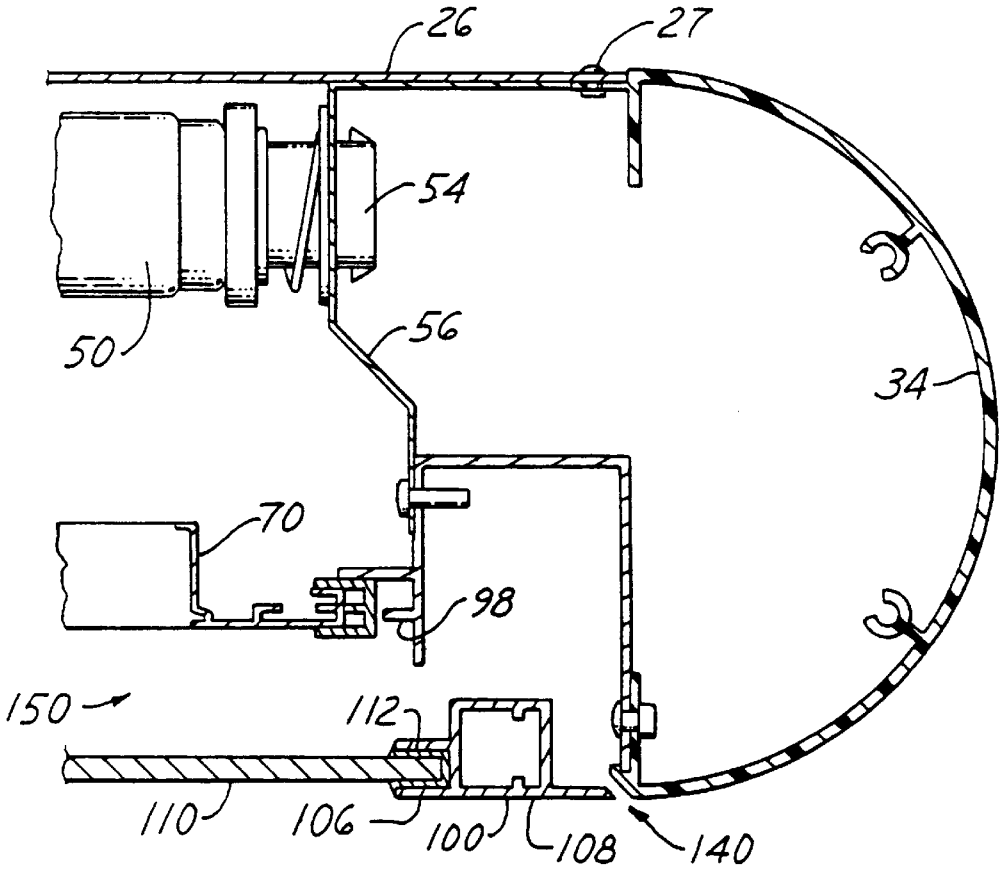

Inside the housing and adjacent the rear panel are positioned a plurality of horizontally disposed fluorescent lamps 50. In the embodiment illustrated in the drawings, six lamps 50 are provided, although it is understood that any number can be utilized depending on the size and configuration of the housing and the desired illumination. The fluorescent lamps can be of any conventional type and preferably are six feet long. A six lamp ballast member 52, which can be of any conventional type but preferably made by Magnetec, is provided to operate the lamps 50. The lamps are positioned in conventional fixture members 54 positioned in interior side members 56 as shown in FIG. 18. The fixtures are-connected to the ballast member by appropriate wiring (not shown) and the ballast in turn is connected by appropriate wiring to a power source (again not shown), both as conventionally known in the art.

The front surface 24 of the housing 22 is open in order to allow illumination from the lamps 50 to project outwardly for viewing by the passing public. A plurality of menu and graphic modules, or advertising and promotional modules are positioned covering the front surface. The modules and display are illuminated from the rear so that the graphic materials, displays and prices on the modules will be visible to the viewing public.

The front surface 24 can be utilized to provide one large graphic message to the passing public, or can be divided into a number of sections or areas. The latter is preferable and six sections are shown in the FIGS. 1–2 of the drawings. As shown, the areas 54,55,56,57,58 and 59 comprise pictures or photographs of various food items, various menu items, various pricing numbers relative to the menu items, and other conventional advertising and promotional items. Preferably, the sections or areas 54–59 of the present invention are covered by frames or modules which can be prepared off site and then installed or assembled in place in the housing for display. This also allows the modular units to be moved around and positioned at any location on the front surface as desired by the business establishment.

One of the embodiments of menu/graphic frame modules 70 for use with the present invention are shown in FIGS. 12–15: The manner in which the modules 70 are positioned in the display 20 is shown in FIGS. 1618. A horizontal aluminum extrusion member 80 divides the front surface into two equal areas. Divider member 80 has a pair of flanges 82 and 84 which hold the outer edges of the menu/graphic frame modules 70 in place.

Figure 16:
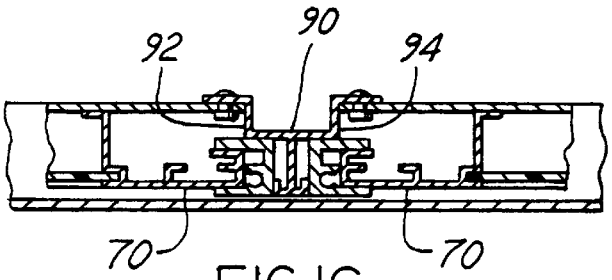
FIGS. 16–18 are cross-sectional views illustrating various details of the display device, the cross-sections being taken along lines 16—16, 17—17 and 18—18, respectively, in FIG. 2 and in the direction of the arrows.
Figure 17:
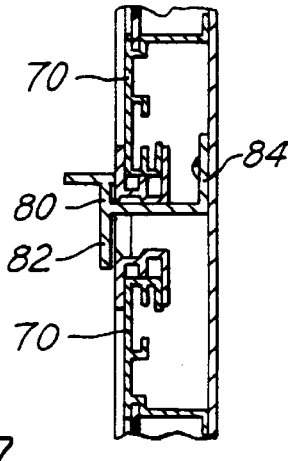

Vertical divider member 90 is used to divide the front area into a series of separate sections, preferably four vertical divider members 90 are utilized, each being an aluminum extrusion in the configuration shown in FIG. 16. Channels 92 and 94 on the vertical divider member hold the edges of the menu/graphic frame modules 70 in position. Also, as shown in FIG. 18, vertical extrusion members 98 are provided along the two outer vertical edges of the front surface area 24. These are adapted to hold the edges of the menu/graphic frame modules 70 in place.

The menu/graphic frame modules 70 shown in FIGS. 12–15 have an outer frame 210 comprised of four frame sections 211–214. The frame sections are mitered at 45° at each end and held together by corner key members 216 to form the frame 210. The frame sections preferably are made from aluminum extruded in the cross-sectional shape shown in the drawings, and the corner key can be made of metal with locking tangs 218 used to hold the key in place in channels 220 in the frame sections. It is understood that the frame sections and key members could also be made of other configurations and from other materials, such as suitable plastic materials, although it is believed that metal members work better in accordance with the present invention. The corner key members could also be attached to the frame sections by screws or other fasteners.

The modules 70 have a plurality of divider members 224 positioned horizontally at predetermined positions on the frame 210. The divider members 224 are elongated aluminum extrusions having a cross-sectional shape shown in FIGS. 13A and 14. The divider members have a U-shaped opening 226 formed by two leg members 228 and 230. The free ends of the leg members 228,230 have locking ridges 232 and 234, respectively. A pair of channels 236 and 238 are present in the other end 240 of the divider members. Although the divider members preferably are made of an extruded aluminum material, other materials of suitable durability could also be utilized.

A plurality of retainer members 250 are secured on the inner edge or surface of two opposed frame sections 211 and 213. The retainer members are preferably made from a plastic material, such as acetal, but any other material could be utilized which can perform the same function and purpose. The retainer members 250 have an angled or sloped end 252 and a pair of grooves 254,256 at the other end. The grooves are adapted to mate with the locking ridges 232,234 of the divider members when the divider members are installed on the module.

The retainer members also have nubs or projections 260 which are adapted to mate with recessor or holes 262 in the frame sections 211, 213. Fasteners 262, such a pop rivets, positioned in openings 264 in the retainer members, secure each of the retainer members to the frame sections. The retainer members also have slits or channels 266 which fit over flanges 268 on the frame sections.

Figure 13A:
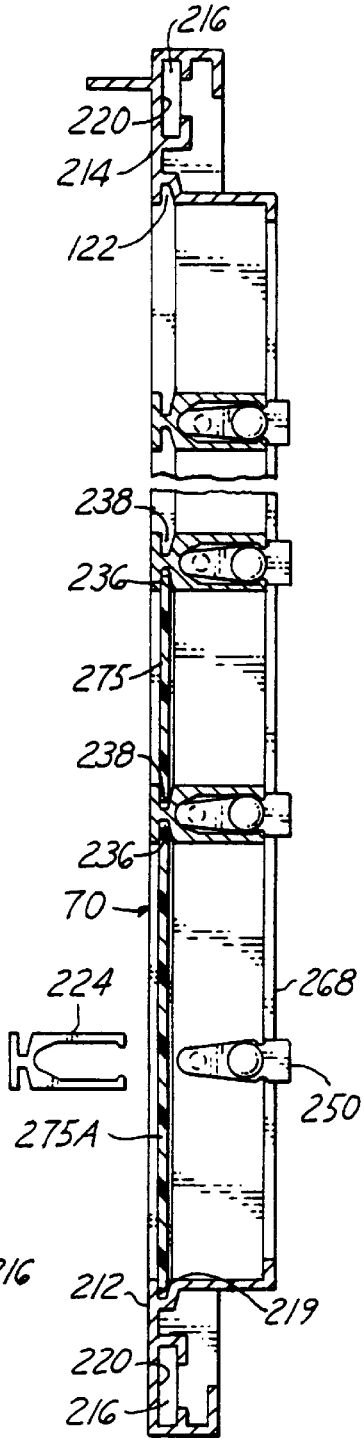
FIG. 13A is a cross-sectional view of the module of FIG. 12, when taken along lines 13A—13A in FIG. 12 and in the direction of the arrows.
Figure 13B:
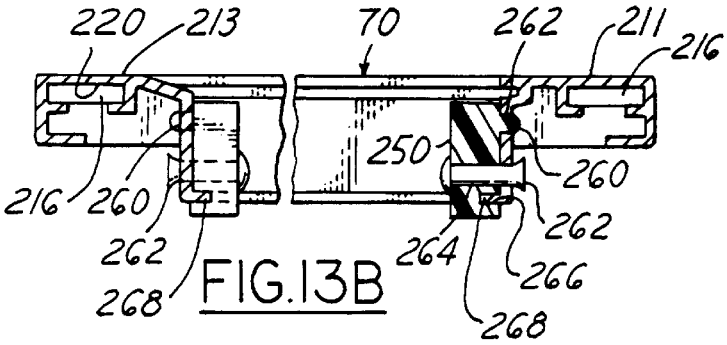
FIG. 13B is a cross-sectional view of the module of FIG. 12, when taken along lines 13B—13B in FIG. 12 and in the direction of the arrows.
Figure 14:
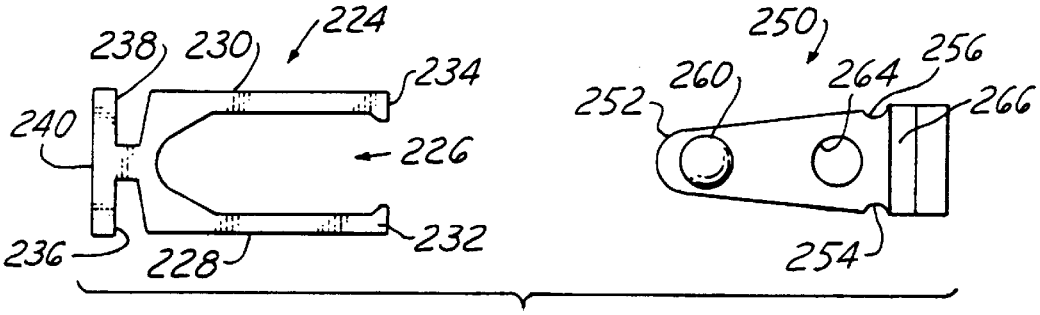
FIG. 14 is an enlarged exploded view of a divider member and retainer member as utilized in the module of FIGS. 12 and 13.

The divider members 224 are used to divide the open face of the module into a plurality of horizontal areas 270 for placement of various menu strips 275 and price modules 280. The menu strips 275 are elongated thin strips of plastic or metal and fit within channels 236,238 between adjacent divider members. The strips 275 can be one space 270 in width, or can span several spaces and divider members. Of course, if the strip 275 is positioned to span several areas, it may not be necessary to provide divider strips beneath the strips, unless they are needed for support. In this regard, strip 275 in FIG. 13A is positioned between adjacent divider members, while strip 275A is positioned spanning over one divider member which has been removed.

The frame sections 212 and 214 are provided with channels 219 and 221 in order to hold an edge of a strip positioned between a divider member and a frame section. In this regard, it is also possible to position a single graphic or display panel covering the entire open front surface of the module 70, the panel being positioned in channel 219 in frame section 212 and in the corresponding channel 221 in frame section 214 (see FIG. 13A). Frame sections 211 and 213 also have strip channels in them in order to hold the ends of the strips.

Figure 15:
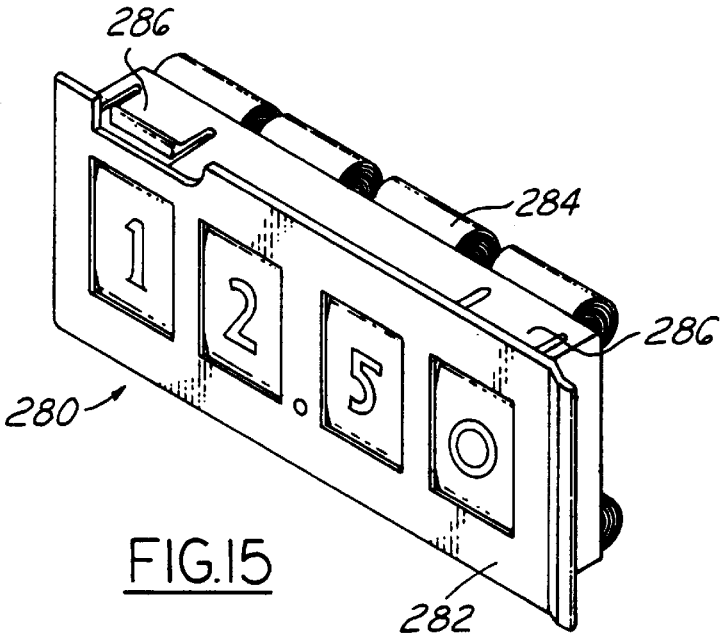
FIG. 15 is a perspective view of a changeable price module for use with the menu/graphic module of FIGS. 12–15.

It is also possible to position one or more price modules 280 in between adjacent divider members 224. One embodiment of price modules which can be used is shown in FIG. 15 and is available from Wolfe Merchandising, Toronto, Ontario, Canada. The price modules 280 comprise plastic housings 282 with a series of adjustable number strits 284 so that the price shown to the public can be changed as desired by the business. Of course, other conventional pricing strips or devices for displaying prices of the menu items to the public could be utilized. Spring locking tabs 286 on the sides of the price modules 280 hold the modules in place between adjacent divider members.

Figure 30:
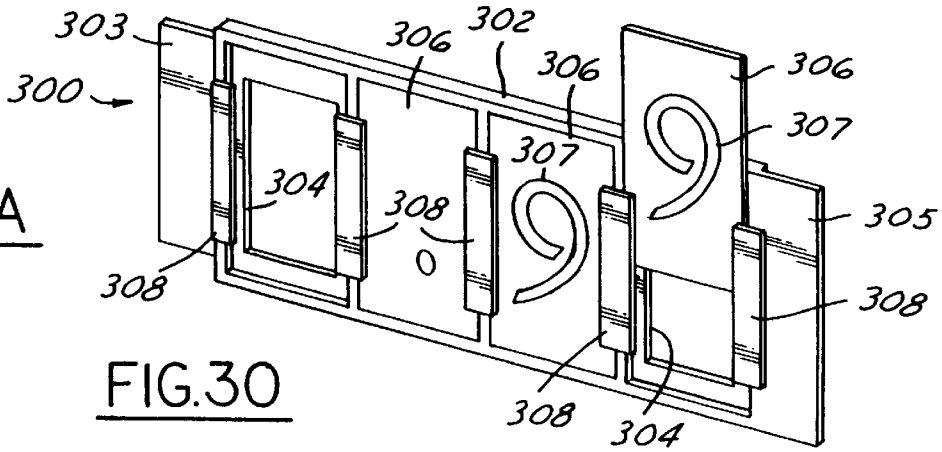
FIG. 30 is a perspective view of another changeable price device for use with the menu/graphic modules of FIG. 12 or FIGS. 26–27.

Another pricing strip which can be used with the present invention is shown in FIG. 30. This module 300, which is made of plastic or equivalent materials, has a flat body member 302 with a plurality of windows or openings 304 (four being shown for illustration purposes). Overlapping light blocking flange members 303 and 305 are provided on the two opposite ends of the body member 302. Small individual number (or blank) members 306 are adapted to be positioned in front of each of the windows 304 and can be easily removed for replacement. Rail members 308 are positioned on the sides of each of the windows and used to hold the number members 306 in place. The actual number, letter or other graphic symbol 307 on the members 306 are made from a clear or translucent material so that they will be visible when the modules 300 are backlit. One or more price modules 300 can be positioned in each of the spaces 270 between adjacent divider members. The body member 302 is sufficiently thin in order to fit in channels 236 and 238 in the divider members.

The modules 70 could be positioned in all or any number of the areas 54–59 of the device 20. Typically, a restaurant will have a few modules which display menu items, with assorted prices, while other modules will have graphic displays of some of the food items themselves. Also, as indicated, the present invention can be used either indoors or outdoors and thus the modules 70 have application in both environments.

Figure 26:
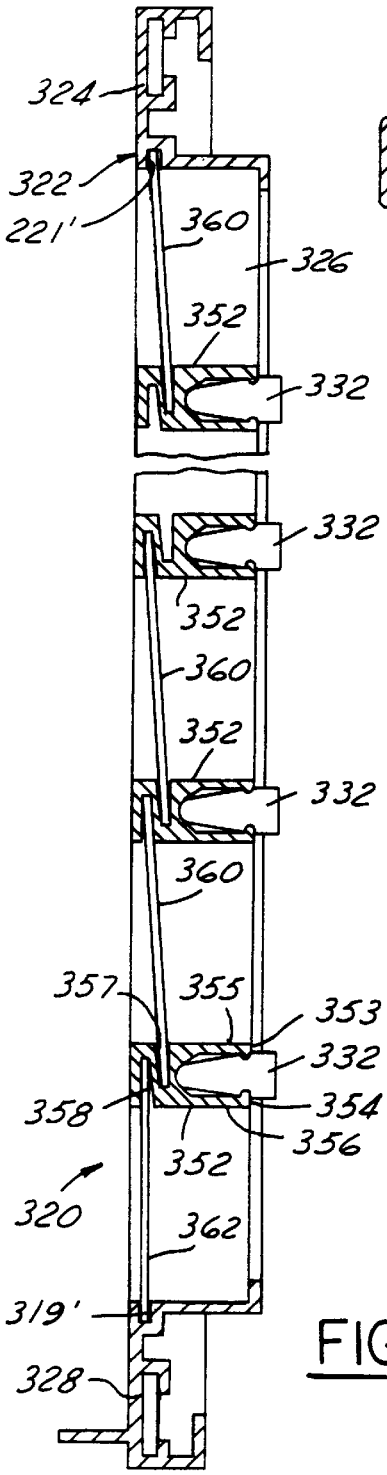
FIGS. 26 and 27 are cross-sectional views, similar to FIGS. 13A and 13B, of an alternate embodiment of a menu/graphic module in accordance with the present invention.
Figure 27:
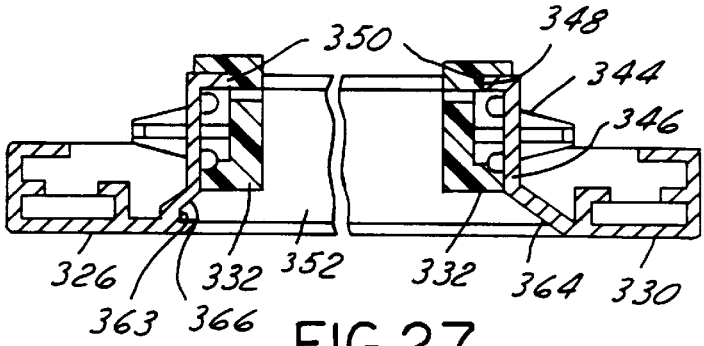
Figure 28:
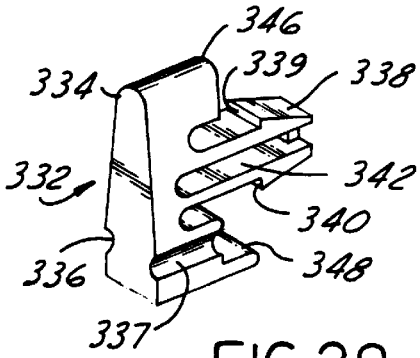
FIG. 28 is a perspective view of a preferred retainer member as utilized with the menu/graphic module of FIGS. 26 and 27.
Figure 29:
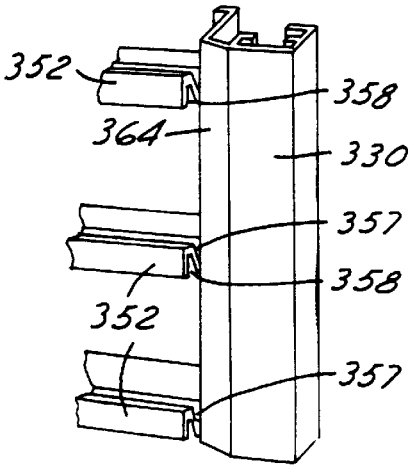
FIG. 29 illustrates menu strip ramps used with the menu/graphic module shown in FIGS. 26–27.

Another preferred embodiment of a menu/graphic module is shown in FIGS. 26–29 and indicated generally by reference numeral 320. A planar elevational view of the module 320 would be the same as that illustrated by module 70 in FIG. 12. FIGS. 26 and 27 are cross-sectional views of module 320 taken along the same lines and in the same manner as FIGS. 13A and 13B with respect to FIG. 12. FIG. 28 depicts a preferred retainer member utilized with module 320 and is positioned in a similar manner and has the same function as retainer members 250 with respect to module 70. FIG. 29 is a perspective view depicting the insertion channels 358 for menu strips between adjacent divider members and highlights the angled surface 364 (ramp member) used to aid in the insertion and placement of such menu strips.

Module 320 has four frame members forming an integral rectangular modular frame 322. Three of the frame members 324, 326 and 328 are shown in FIG. 26. The fourth frame member 330 is shown in FIG. 27. Frame members 324, 326, 328 and 330 correspond to frame members 211–214 in FIG. 12 and are held together in the same manner.

Side frame members 326 and 330 have a plurality of retainer members 332 which are spaced uniformly along the inside edges thereof. The members 332 are preferably made of DELRIN®, acetal, or a similar engineering grade plastic material. The retainer members have a sloped end 334 and a pair of grooves 336 and 337. A protruding locking member 338 having a pair of locking tangs 339 and 340 allows the retainer members 332 to be securely attached to the frame members. Slot 342 positioned between the locking tangs allows the tangs to be squeezed together sufficiently to allow the protruding member 338 to be inserted through openings 344 in the frame members. End surface 346 abuts the frame member and holds the retainer members firmly in position. Channel 348 is adapted to mate with flange 350 on the frame members and assist in holding retainer members in fixed position and orientation.

A plurality of elongated divider members 352 are positioned horizontally in the module 320 and secured to pairs of retainer members 332. Locking ridges 353 and 354 on leg members 355 and 356, respectively, are adapted to mate with grooves 336 and 337 on the retainer members 332 and thereby releasably retain the divider members in place. A pair of channels 357 and 358 are provided in each of the divider members and used to hold and display menu strips 360 or other display materials 362, as shown in FIG. 26. In contrast with channels 236,238 in the divider member 224 discussed above with reference to FIGS. 12–15, the channels 357 and 358 are overlapped and staggered in the vertical direction on each of the divider members 352. In this manner, a larger number of menu strips or a greater area of display materials can be positioned in each of the modules 320.

Slots or channels 219' and 221' are provided in the two horizontally disposed frame members 328 and 324, respectively, and are utilized to retain edges of menu strips or display materials in the same manner as channels 219 and 221 discussed above with reference to FIG. 13A. Channel or slot 363 is provided along frame member 326 for essentially the same purpose, namely to hold and retain the ends of menu strips and display materials positioned in the module 320 between adjacent divider members. Angled surface or ramp member 364 is provided in frame member 330 in order to assist in introducing a menu strip or display member between pairs of adjacent channels 357 and 358 (see FIGS. 27 and 29). In addition, angled surface or ramp member 366 is provided in frame member 326 adjacent channel 363 in order to assist in positioning the ends of the menu strips and display members in the channel 363 (see FIG. 27).

Figure 29A:
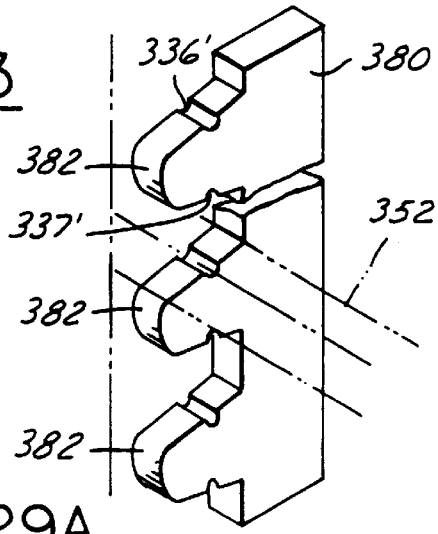
FIG. 29A depicts an alternate embodiment of retainer members which can be used with the present invention.

Although the invention has been described with reference to use of a plurality of individual retainer members (members 332 in FIG. 26 and members 250 in FIG. 13A), it is also possible in accordance with the present invention to utilize other mechanisms for releasably retaining the elongated divider members in the modular frame device. For example, as shown in FIG. 29A, an elongated formed (cast, molded, extruded, cut) strip member 380 could be provided with a plurality of retainer projections 382 thereon, and the formed strip member could be secured to the two inside vertical sides of the modular frame device. Grooves 336' and 337' would act to hold the horizontal divider members 352 in place. As another alternative, a plurality of retainer projections or members could be formed integrally as part of one or both of the vertical side frame members. Combinations of these various alternatives could also be utilized (e.g. with individual retainer members on one frame member and formed retainer projections on the opposed frame member).

A door member 100 is attached to the front of the housing 22 (see FIGS. 1–4 and 18). The door member 100 is pivoted about hinge mechanism 102 and also attached to the housing by a pair of gas-assisted spring members 104. The spring members 104 allow the door member 100 to rise slowly once it is unlatched. The spring members 104 also hold the door member in place when it is open and prevent it from being raised too high. Spring members could also be provided which simply pop the door open slightly (a few inches) and then assist persons manually opening the door to its maximum extent. With these spring members, opening of the door to its full extent is not automatic.

Figure 9:
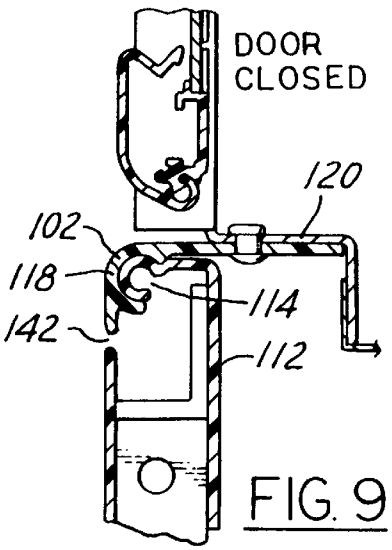
FIGS. 7–9 are enlarged partial cross-sectional views depicting a first hinging mechanism for the door member in accordance with the present invention.
Figure 8:
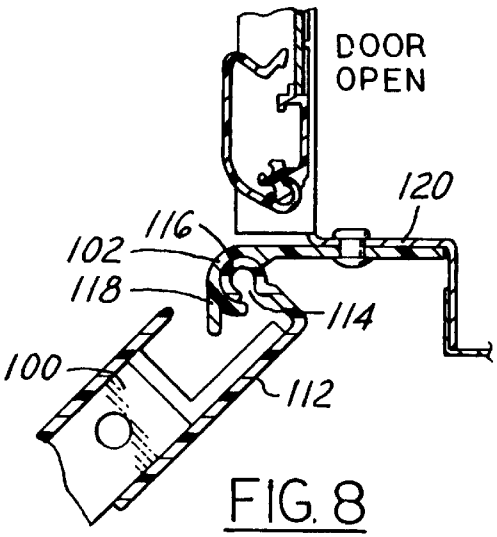
Figure 7:
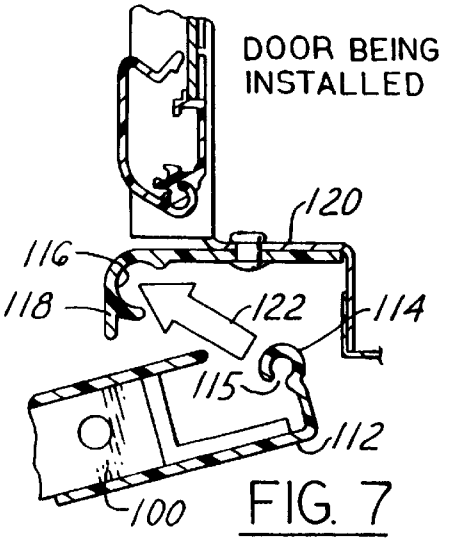
Figure 12:
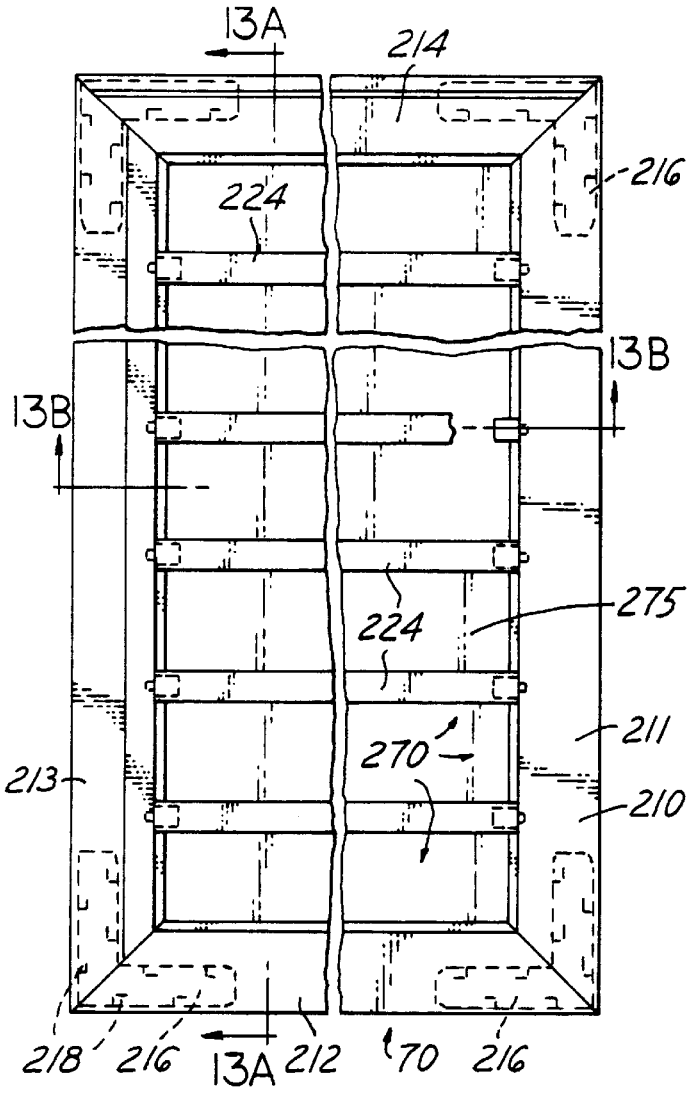
FIG. 12 depicts a menu/graphics module in accordance with the present invention.

A frame 106 consisting of a plurality of frame extrusion members 108 is provided around the edges of the door member 100. A piece of tempered glass 110 held in the frame members with vinyl glazing 112 is positioned inside the frame 106 to form the door member 100. The upper edge of the door member 100 that forms part of the hinge mechanism 102 has a separate extrusion 112, as shown in FIGS. 7–9. The hinge member 112 has a rounded pintle portion 114 which mates with a circular socket 116 on mating hinge extrusion member 118 which is connected to the upper panel member 120. In order to prevent the door from being improperly removed, hinge members 112 and 118 are formed in the configuration shown so that they can only be assembled and disassembled in the manner shown in FIG. 7. The installed hinge mechanism 102 is shown in FIGS. 8 and 9 with the door being in an open position in FIG. 8 and in a closed position in FIG. 9. Once the door 100 is assembled on the housing as shown in FIG. 7, and the spring members 104 are connected to the door and secured to the housing, the door member 100 cannot be disassembled from the housing.

In this regard, the curved portion of the pintle member 114 is dimensioned such that it will fit within the socket 116 in the direction shown by the arrow 122 in FIG. 7, but cannot be disassembled when the door member 100 is in either of the positions shown in FIGS. 8 or 9 or anywhere between those two positions. The socket 116 is curved more than 180° in order to retain the pintle member 114 in it. The pintle member 114 also has a curved member of more than 180°, but also has an open portion 115 which allows assembly with the socket member as shown in FIG. 7.

Several hinge members 112 on the order of 6–8 inches in width are provided along the top edge of the door 100. Preferably about 2–4 hinge members 112 are needed for the display device. As indicated, the door extrusion members 108 are positioned along the four exterior front edges of the glass 110 forming the frame 106. The plurality of hinge extrusion members 112 are positioned along the upper edge of the door member. The hinge extrusion members are formed from an extruded aluminum material and are provided in the size and shape shown in the drawings, particularly FIGS. 7–9. The hinge extrusion members are secured to the door member along the upper edge in any conventional manner, such as welding, rivets, or other fasteners.

When the hinge extrusion members are secured to the door extrusion member along the upper edge of the door member, the door assembly can be rotated to its open and closed in order to provide access to the advertising and promotional materials and to prevent their exposure to environmental elements and vandalism.

FIGS. 22–24 illustrate the assembly and the open and closed positions of door member 400 in a perspective manner. Once the pintle member 414 on hinge member 412 is assembled together with socket member 416 on hinge member 418, as shown in FIG. 22, and the spring members are attached to the housing and door member, then the door member 400 cannot be removed or disassembled in any unauthorized manner. This prevents unauthorized entry into the housing and also provides a display device having a more aesthetic, smooth exterior surface without any visible or protruding hinges.

Figure 19B:
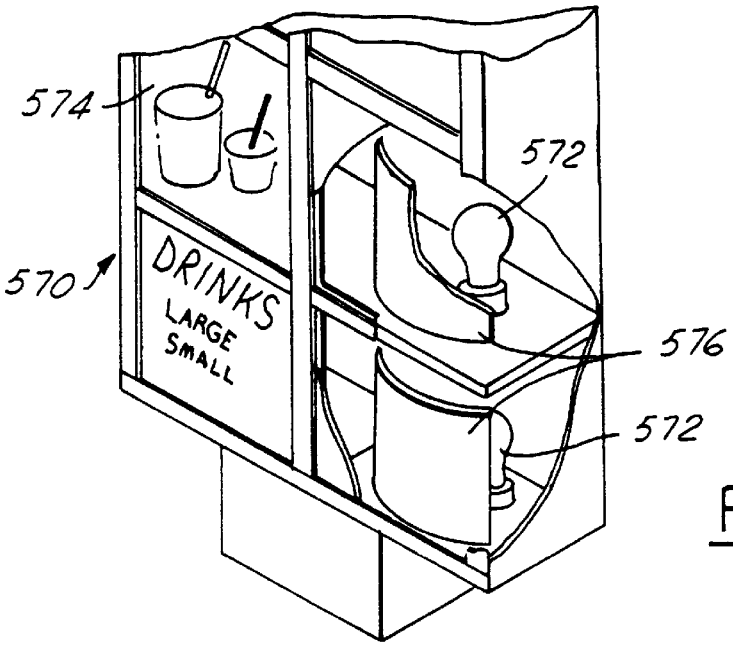
FIG. 19B illustrates an alternate embodiment of the invention which utilizes point light sources and light diffuser members to backlight the menu displays in the housing.
Figure 19:
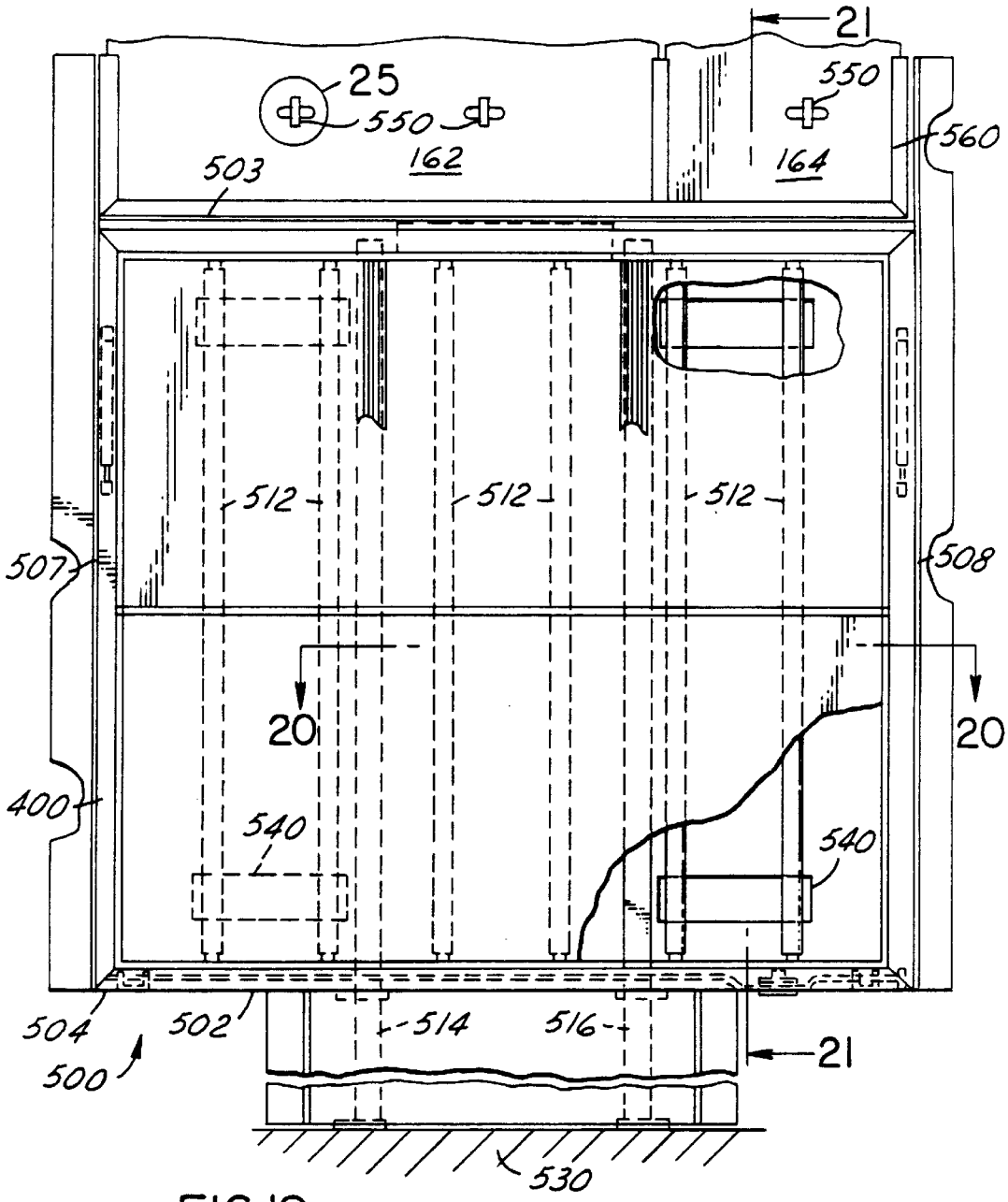
FIG. 19 illustrates an alternate embodiment of an illuminated lightbox device in accordance with the present invention.
Figure 20:
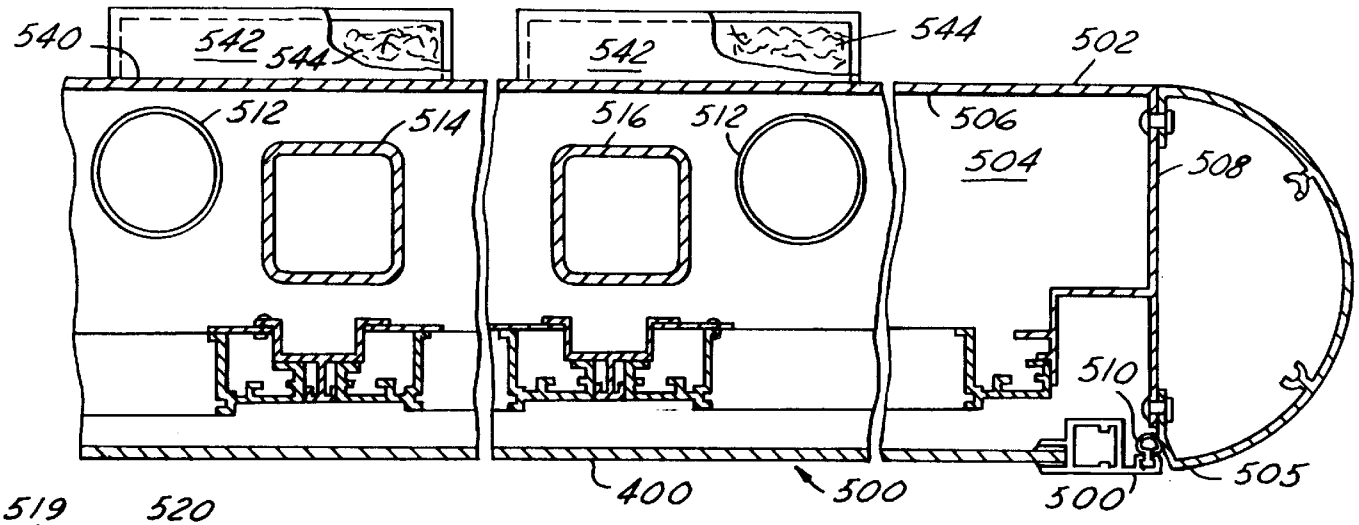
FIG. 20 is a cross-sectional view of the lightbox device shown in FIG. 19, the cross-section being taken along line 20—20 in FIG. 19 and in the direction of the arrows.

Also, in accordance with a preferred embodiment of the invention which is shown and disclosed with reference to FIGS. 19–21, the hinge member 412 extends across the entire width of the housing. A sealing member 420 can be used to seal the top outer visual edge of the door member 400 with hinge member 418, but is not preferred. The sealing member 420 can be of any conventional type and can be made of any conventional sealing material, such as rubber or another elastomer.

With the present invention, the door member can be more easily removed for service or change without having to unscrew or disconnect a hinge mechanism, as with conventional doors on conventional box-like products.

Figure 10:
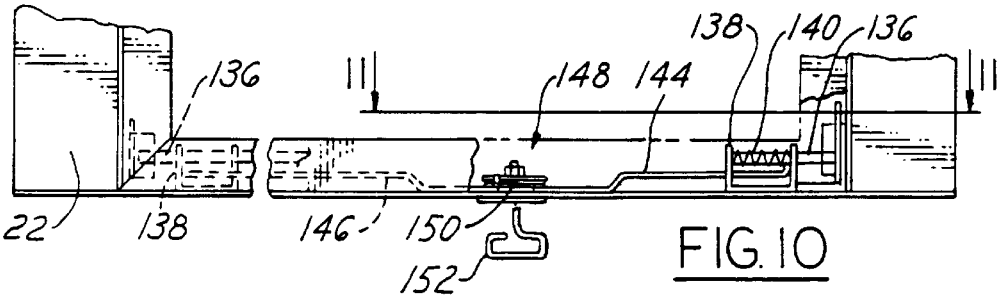
FIG. 10 is an enlarged view partially in cross-section of the lower portion of the housing shown in FIG. 2 and depicting the door latching mechanism.

A latching mechanism 130 (as shown in FIGS. 3A, 10 and 11) is used to secure the door member 100 to the housing 22 when the door member is in its closed position. The latching mechanism includes a pair of C-shaped latch members 132 attached to the lower corners of the door 100. The members 132 have U-shaped openings 133 in them and a spring activated finger member 134 which only can be moved in one direction. The latch members 132 are secured to the opposite lower corners of the frame 106 on the door member 100.

The latch mechanism 130 also includes a pair of pin members 136 on the housing 22. The pin members 136 are positioned on the opposite inside corners of the housing and are positioned to mate with the U-shaped openings 133 in the latch members 132 when the door member 100 is in its closed position. The pin members 136 are positioned in a U-shaped brackets 138 and are spring biased by coil springs 140. The pin members 136 slide or move in the direction of the arrow 142 (FIG. 11).

The pin members 136 are attached to elongated rod members 144 and 146 which are activated by turn lock mechanism 148. The turn lock mechanism 148 has a socket 150 for an alien wrench or key 152. When the key 152 is inserted in the socket 150 and-turned or rotated, this in turn rotates the turn lock mechanism 148 in the direction of the arrow 154 shown in FIG. 11. This in turn operates to move the rods 144,146 which in turn move the pin members 136 out of engagement with the latch member 132 on the door member 100 thereby allowing the door to open.

When the door is in a closed position, the glass member 110 and frame 106 are positioned flush with the front surface of the housing 22. In this position, the latch members 132 are held in place by the pin members 134 which are positioned in the U-shaped openings 133 of the latch members 132. When it is desired to release the latching mechanism and allow the door 100 to be opened, turn lock mechanism 148 is activated by key member 152 and the pin members 136 are released from engagement with the latch members 132. The assistance provided by the spring members 104 moves the door member 100 a short distance away from the front surface of the housing in order to allow the door to be manually opened to its full open position (as shown in FIG. 3).

In one preferred embodiment of the invention, an air space 140 is provided around at least the two side and bottom edges of the door frame 106 when the door is in the closed position. This is shown in FIG. 18. A similar air gap 142 can be provided along the upper edge of the door member 100, as shown in FIG. 9. Since hinge members 112 are on the order of 6 to 8 inches in width and only 2–4 of them are provided across the several foot width of the housing 22, the air gap 142 allows sufficient quantities of air to pass through it along the top edge of the door 100.

The air gaps 140,142 allow air to circulate behind the glass door member 100 and in front of the menu/graphic frame modules 70. This allows any buildup of heat to escape from the area 150 between the door member and the displays and also prevents a buildup of water vapor and condensation which may adversely affect the graphic materials. Any buildup of condensation or water vapor on the inside of the glass 110 could also blur or distort a clear view of the menu and graphic materials displayed in the illuminated lightbox device.

Another preferred lightbox device in accordance with the present invention is shown in FIGS. 19, 19A, 20 and 21, and indicated by the reference numeral 500. The device 500 has a housing 502 formed in a rectangular box shape with six outer surfaces (top member 503, bottom member 504, front member 505, back member 506, and two side members 507 and 508). The door member 400 is attached to the front member 505. The door is sealed by sealing members 510 to the front member along the two sides and lower edge of the door. The door is hinged to the top member 503 by the hinge mechanism shown in FIGS. 22–24.

Figure 19A:
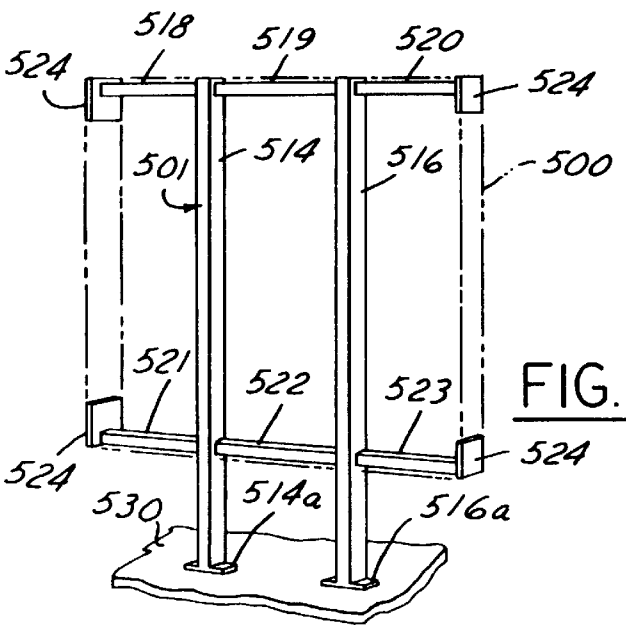
FIG. 19A is a perspective view of the frame used to support the lightbox device shown in FIG. 19.

In contrast to the fluorescent lamps positioned horizontally in the embodiment shown in FIGS. 1–4, the fluorescent lamps 512 positioned in housing 502 are positioned vertically. This is shown in FIGS. 19–21. In addition, the supporting framework 501 for the device 500 includes a pair of vertically upright steel support members 514 and 516, and a plurality of horizontal steel support members 518–523 welded to the vertical members. This is shown in FIGS. 19 and 19A. Steel plate members 524 are welded to the outer ends of the horizontal members to add stability and fastening surfaces for the outer surface members of the housing. The steel supporting framework, as shown in FIGS. 1921, may provide a more stable display device 500 than the supporting framework for the display device 20 as described above.

The lower ends 514*a* and 516*a* of the framework 501 are attached or secured in any conventional manner to an appropriate concrete base or other equivalent member 530.

An alternate embodiment of the invention is shown in FIG. 19B. In this embodiment 570, a plurality of point light sources 572, such as halogen lamps, are provided in the housing 574 in order to backlight the menu modules and other display materials. Diffuser members 576 are positioned in between the point light sources and the backlit displays in order to spread out the illumination evenly on the display. The diffuser members preferably have a plurality of patterned openings or spaces, the openings being spaced to even out the light distribution. Illumination systems and light diffusers of this type are shown, for example, in co-owned U.S. Pat. No. 5,381,324, the disclosure of which is hereby incorporated by reference herein.

In accordance with the embodiment shown in FIGS. 19–21, the sides of the housing can have square edges, or can be provided with bullnose cover members 532, as shown in FIGS. 19 and 20. Also, the portions of support members 514 and 516 which extend below the bottom member 504 can be covered with a housing with square or rounded edges.

Fresh cooling air is circulated through the housing 502 through openings in the back member 506. One or more air vents 540 are provided in the back member adjacent the lower or bottom member 504 in order to allow fresh air to enter the housing. The air vents 540 are covered with cap members 542. Filter members 544 are positioned in the cap member to prevent dust and other impurities from entering the inside of the housing. One or more exit openings 546 are provided in the back member 506 in order to allow hot air to escape from the housing. The openings 546 are covered by cap members 548. Cap members 542 and 548 prevent unauthorized entry into the housing and also keep rain, snow, debris and other environmental elements from entering the housing.

Louvers could also be provided on the housing for air circulation in place of the cap members and openings. The rear panel of the housing could be provided with a plurality of slits and openings, and louvers could be formed around them. Conventional filter materials, such as foam members, could be secured inside the housing covering the openings.

Figure 5:
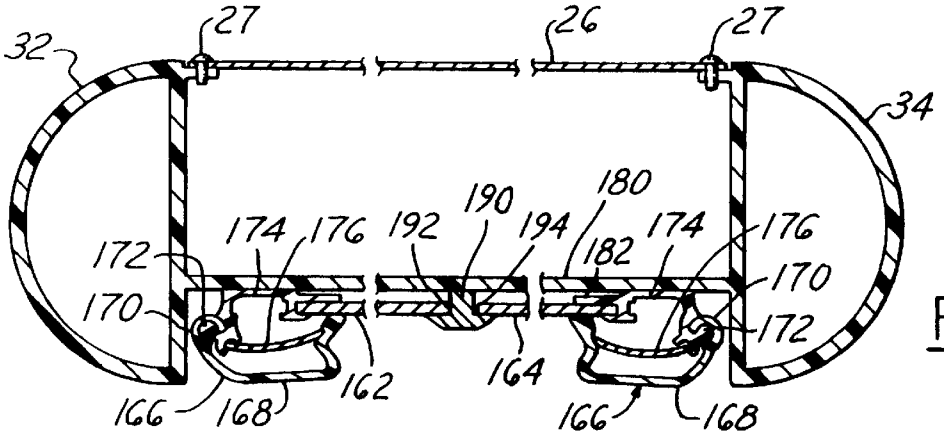
FIG. 5 is a cross-sectional view of the illuminated lightbox device as shown in FIG. 2 when taken along lines 5—5 in FIG. 2 and in the direction of the arrows.

A second area or portion 160 is provided on the housing 22 for display of additional advertising and promotional materials. The advertising and promotional materials are designated generally by the numbers 162 and 164 in FIG. 1. The materials are also shown in FIG. 5. Spring-type clamping members 166 are provided along the lower edges and two side edges of the area 160. The clamping members 166 are preferably of the type described and shown in U.S. Pat. No. 4,145,828 which is assigned to the same assignee as the present invention. The clamping members 166 comprise an external cover member 168 which has an elongated circular hinge formation 170 at one end and mates with a pintle formation 172 on the base member 174. Cover member 168 is adapted to rotate between an open position in which the advertising and promotional materials 162,164 can be inserted or changed in space 160, and a closed position in which the cover member 168 rests on the materials 162,164 and holds them in place along two of their edges. A plurality of leaf spring members 176 are used to bias the clamping cover members 168 in an over-center manner and allow the covers 168 to be snapped and held in their open and closed positions. This is shown in U.S. Pat. Nos. 4,145,828 and/or 3,310,901, the disclosures of which are incorporated by reference.

An extruded T-shaped divider member 190 is positioned on the panel member 180 and secured thereto by any conventional fastening means. The divider member 190 has a pair of channel members 192,194 which allow placement of the materials 162,164 and holds them in place.

The divider member 190 can be positioned at any convenient position along the panel member 180. As shown in FIGS. 1 and 2, the divider member is preferably positioned such that one large display member 162 can be utilized, together with one smaller display member 164.

To assure that the advertising and promotional materials 162,164 remain in place in the section 160 of the housing 22, a plurality of spring clips 200 are provided along the upper surface 28 of the housing. The spring clips are provided at certain locations along the upper surface 28 and are adapted to be positioned through openings 202 provided in the display materials 162,164. The spring clips are secured to the upper surface in any conventional manner, such as by rivets 204. The spring clips have a downwardly extending flange member 206 on the outer end which hooks over the promotional materials 162,164 to help hold them in place.

With use of the spring clips and the clamping members 166, the poster display materials 162,164 are placed on the housing 22 in the following manner. First, the cover members 168 of the clamping members 166 are all rotated to their open positions. The display materials 162,164 are then positioned in place against the panel members 180. In this regard, the edges of the materials 162,164 are positioned in the channels 192,194 of the divider member 190 and the spring clips 200 are inserted through the openings 202. Thereafter, the cover members 168 are snapped to their closed positions, as shown in FIG. 5, securely holding the display materials 162,164 in place.

Figure 25:
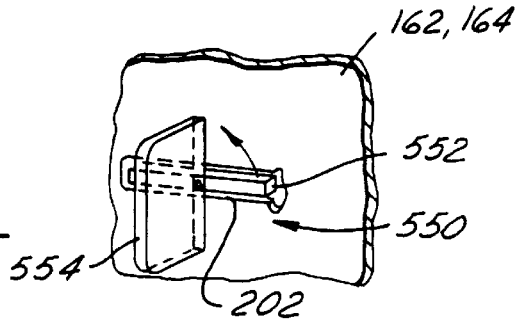
FIG. 25 depicts a turn-lock fastening mechanism as depicted in area 25' in FIG. 19.

Another mechanism for holding the display materials 162,164 in place on the housing is shown in FIG. 25. The mechanism 550 is a turn-lock device with a stationary base member 552 which protrudes slightly through opening 202 in the display materials and a rotating locking member 554 which can be rotated 90° relative to the base member. The locking member 554 is rotated to a first position in alignment with the base member 552 in order to remove and replace display materials on the housing. Once the display materials are situated in their desired positions, the locking member 554 is rotated 90° relative to the base member, thereby securely holding the display materials in position.

In another preferred form of the present invention, both portions of the lightbox are illustrated. In contrast to the embodiment shown above which has a non-illuminated second area or portion 160, the device 500 can have a second illuminated lightbox member 560' positioned on the top member 503. The member 560' can have one or more fluorescent lamps 562 positioned in it and provide illumination to backlight the display materials 162 and 164. The lightbox member 560' can be a separate modular member which is fastened to the housing 502 by any appropriate or conventional means. Also, if a second illuminated lightbox member is provided, then the front of the lightbox comprises a transparent panel. Rotating locking members, such as 554, are not utilized. Instead, the display piece is preferably attached around all four sides or edges with biasing clamping frame members.

With the present invention, it is possible to provide an illuminated lightbox device which is versatile and adaptable to numerous forms and configurations. The device has a central or main illuminated lightbox which can have modular members attached to it to increase its size and advertising capacity. These additional members can be illuminated or non-illuminated as desired. The device also can be provided with rounded end caps in order to provide a different aesthetic appearance. These aspects of the invention are illustrated schematically in FIGS. 31–36.

Figure 31:
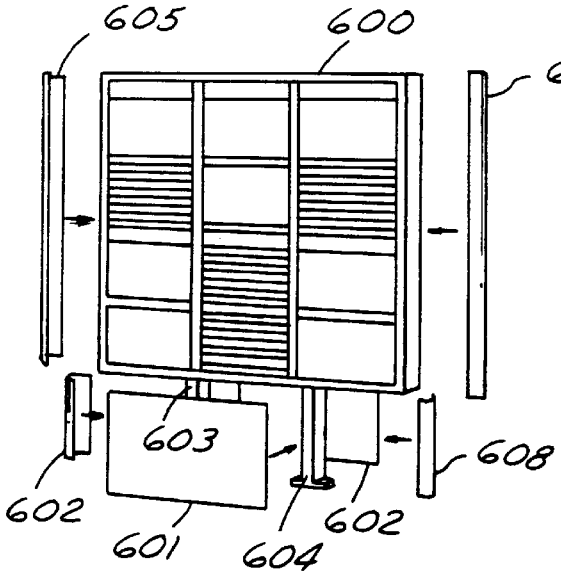
FIGS. 31–36 depict various embodiments of illuminated lightbox devices in accordance with the present invention and illustrate the modularity features of the alternate embodiments.

In FIG. 31, a main illuminated lightbox housing 600 is provided with square edges. The housing 600 can be similar to housing 20 or housing 502 described above. A pair of panel members 601 and 602 are used to box in the lower ends of the support members 603 and 604. A plurality of rounded (bullnose) cap members 605, 606, 607 and 608 can be used to provide a rounded appearance to the housing.

Figure 32:
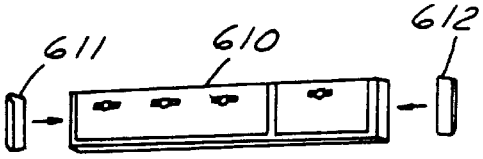
Figure 32:
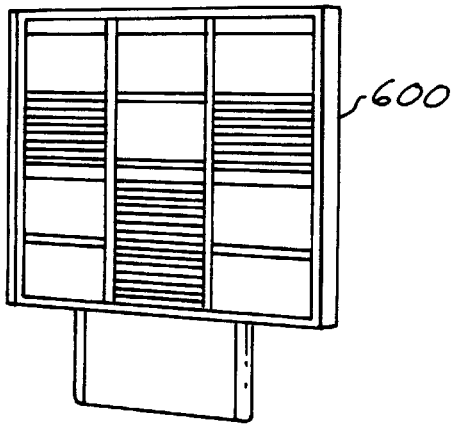
Figure 33:
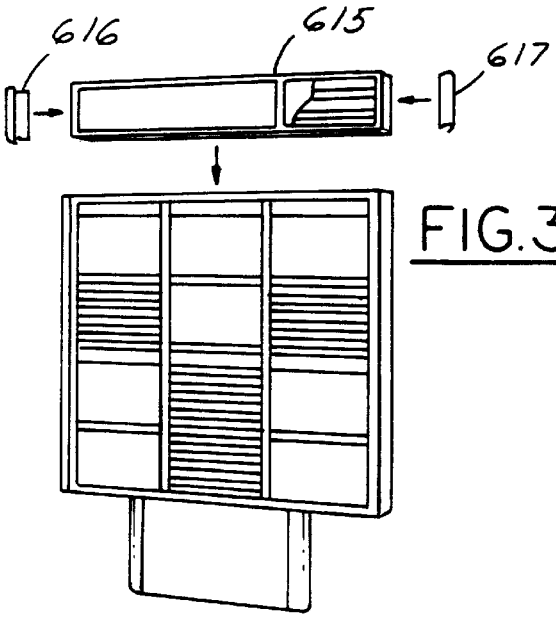

In a second configuration illustrated in FIG. 32, a non-illuminated box-shaped housing 610 is assembled on top of the main housing 600. The housings 600 and 610 can be connected together in any conventional manner, such as with screws, bolts, or other fasteners. End caps 611 and 612 can be added if the main housing 600 also has end caps. In FIG. 33, a second illuminated housing 615 is attached to housing 600. End caps 616 and 617 can be provided as desired.

Figure 34:
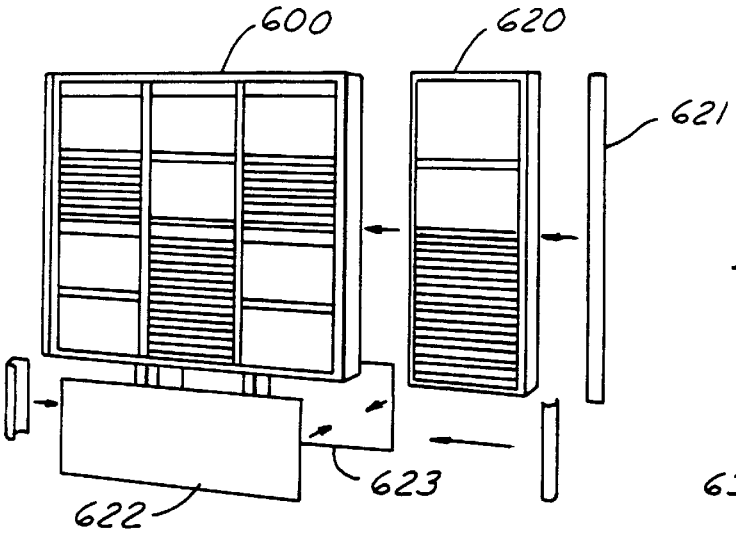

If more display space or area is desired, then another housing 620 can be attached to one of the sides of the main housing 600. This is shown in FIG. 34. If an end cap 621 is present on the side of housing 600, it can be easily removed and placed on the side of the added housing 620. In order to "center" the configuration of the base for the combined housings 600 and 620, extended panel members 622 and 623 can be provided.

Figure 35:
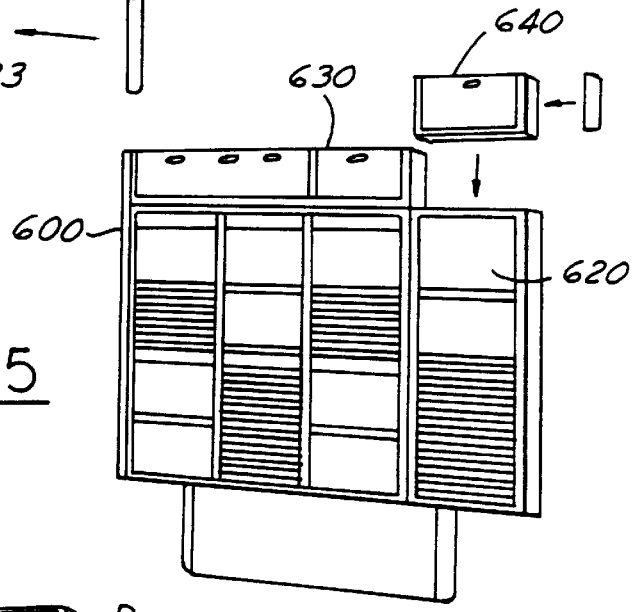
Figure 36:
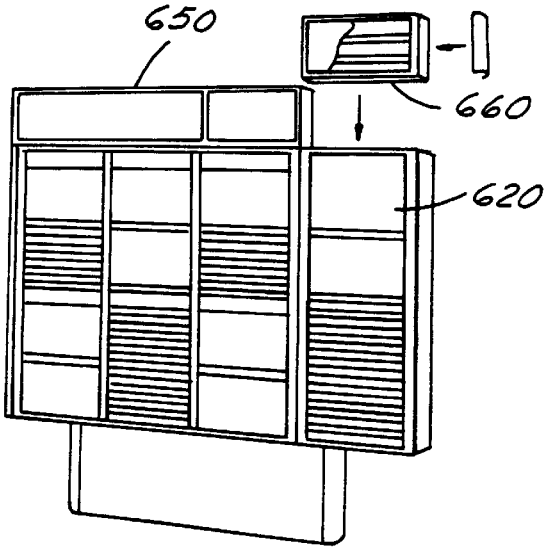

FIG. 35 depicts the combined modular housings 600 and 620 when they are in turn combined with non-illuminated upper or second modular housings 630 and 640. FIG. 36 illustrates the similar situation in which illuminated modular housings 650 and 660 are attached to housings 600 and 620.

As shown in FIGS. 31–36, the present invention allows use of numerous combinations of modular units—both illuminated and non-illuminated—which can be provided in various configurations as desired.

Although particular embodiments of the present invention have been illustrated in the accompanying drawings and described in the foregoing detailed description, it is to be understood that the present invention is not to be limited to just the embodiments disclosed, but that they are capable of numerous rearrangements, modifications and substitutions without departing from the scope of the claims hereafter.

What is claimed is:

1. In an illuminated display device having a housing, a source of illumination positioned inside the housing, at least one display module positioned in said housing for holding and displaying display members, and at least one transparent door member hingedly attached to the housing for allowing access to the interior of the housing and changing of said display members in said at least one display module, the improvement comprising:

said display module having a generally rectangular frame with first and second opposed generally vertically disposed frame members and third and fourth opposed generally horizontally disposed frame members, a plurality of retention members positioned along said first and second vertically disposed frame members, a plurality of horizontally disposed divider members positioned on said frame, said divider members being individually removably held in place by opposed pairs of retention members, first channel means in said divider members for securing portions of display members, and second channel means in said third and fourth horizontally disposed frame members, said second channel means for securing portions of display members, wherein when display members are positioned between opposed sets of channel means, light from said source of illumination can be projected therethrough.

2. The illuminated display device as set forth in claim 1 wherein at least two display modules are positioned in said housing.

3. The illuminated display device as set forth in claim 1 wherein said retention members have projecting portions thereon and said divider members have recesses therein, and when said divider members are positioned on said frame, said recesses mate with said projection portions.

4. The illuminated display device as set forth in claim 1 further comprising a plurality of display members positioned between opposed sets of channel means, said display members having translucent portions thereon.

5. In a display device having a housing member and at least one adjustable menu board positioned inside said housing, said adjustable menu board comprising:

an assembled frame having a top member, a bottom member, and a pair of side members generally defining a plane, and a space defined between said top, bottom, and side members;

said side members including a plurality of horizontally spaced divider member support members disposed vertically along said side members;

a plurality of generally parallel divider members selectively engageable and disengageable at their opposite ends with different one of said divider member support members, said divider members thereby being selectively positionable at regularly and variably spaced locations vertically along said side members in a direction intersecting the plane defined by said frame to provide the same and different spacing between adjacent pairs of said divider members; and a plurality of elongated menu strips having descriptive indicia thereon;

said divider members having first channel means therein for securing portions of said menu strip;

said top member and bottom member having second channel means therein for securing portions of said menu strip;

wherein each of said menu strips are disposed between opposed sets of channel means.

6. The adjustable menu board of claim 5 wherein said end of said divider members are releasably engageable with said support elements.

7. The adjustable menu board of claim 5 wherein at least one of said menu strips has a height measured in a direction parallel to the length of said side members that is different than the height of said at least one other menu strip.

8. The adjustable menu board of claim 5 wherein said support elements are disposed at predetermined equally spaced intervals along the length of said side members.

9. The adjustable menu board of claim 5 wherein each of said menu strips has a height measured in a direction parallel to the length of said side members that is substantially a multiple of said predetermined intervals.

10. The adjustable menu board of claim 5 further comprising a light transmitting source positioned rearwardly of said menu board and operable to back light said plurality of elongated menu strips.

11. A displaying device comprising:

a first portion having a first housing member, a source of illumination positioned inside said housing, a plurality of display members, at least two display modules positioned in said housing for holding and displaying said display members, and at least one door member on said housing for allowing access for changing of said display members; and a second portion having a second housing member, said second portion secured to said first housing member for displaying display members;

each of said display modules having a frame assembly with a top member, a bottom member and a pair of side members, a plurality of retention members, a plurality of divider members, and a plurality of display members, said plurality of retention members being positioned along said side members, said divider members being selectively engageable and disengageable with said retention members, and said display members being dispersed between and supported by pairs of retention members;

each of said divider members having first channel means therein for holding portions of one of said display members, and said top member and said bottom member having second channel means therein for holding portions of one of said display members, wherein said display members are positioned between opposed sets of channel means.

* * * * *

US006125565C1

(12) EX PARTE REEXAMINATION CERTIFICATE (5012th)

United States Patent
Hillstrom

(10) Number: US 6,125,565 C1
(45) **Certificate Issued: *Nov. 2, 2004**

(54) OUTDOOR MENU DISPLAY DEVICE

(75) Inventor: David U. Hillstrom, Novi, MI (US)

(73) Assignee: Marketing Displays, Inc., Farmington Hills, MI (US)

Reexamination Request:
No. 90/005,960, Mar. 22, 2001

Reexamination Certificate for:

| | |
|---|---|
| Patent No.: | **6,125,565** |
| Issued: | **Oct. 3, 2000** |
| Appl. No.: | **09/283,069** |
| Filed: | **Mar. 31, 1999** |

( * ) Notice: This patent is subject to a terminal disclaimer.

Related U.S. Application Data

(63) Continuation of application No. 08/893,603, filed on Jul. 14, 1997, which is a continuation-in-part of application No. 08/702,101, filed on Aug. 23, 1996, now Pat. No. 5,682,694, which is a continuation of application No. 08/317,690, filed on Oct. 5, 1994, now abandoned.

(51) Int. Cl.[7] ..... G09F 13/04
(52) U.S. Cl. ..... 40/574; 40/568; 40/576
(58) Field of Search ..... 40/564, 568, 574, 40/576, 585, 605, 607, 611; 312/139; 362/362, 812

(56) References Cited

U.S. PATENT DOCUMENTS

| | | | | |
|---|---|---|---|---|
| 1,258,146 | A | | 3/1918 | Russell |
| 1,831,228 | A | * | 11/1931 | Clark ..... 40/584 |
| 1,841,026 | A | | 1/1932 | Greenstone |
| 2,079,230 | A | | 5/1937 | Shively |
| 2,319,910 | A | | 5/1943 | Adler |
| 2,976,634 | A | | 3/1961 | Ashley |
| 3,685,186 | A | | 8/1972 | Goodman |
| 4,364,616 | A | | 12/1982 | Harkins et al. |

FOREIGN PATENT DOCUMENTS

| | | |
|---|---|---|
| GB | 318014 | 8/1929 |

* cited by examiner

*Primary Examiner*—Brian K. Green

(57) ABSTRACT

An improved outdoor illuminated display device. The device generally comprises a modular housing, a base member and a plurality of lights positioned in the housing—either horizontally or vertically. A plurality of display modules are positioned on the housing and backlit by the lights. A door member is pivotally connected along its upper edge to the housing covering the modules. A pair of gas-assisted spring members are provided between the door member and the housing. Air gaps or air vents are provided in order to allow air circulation in the housing. A second member above the door member is provided for holding and displaying posters and other advertising and promotional materials. A plurality of clamping members hold the display materials in place. The second member can be illuminated or non-illuminated. Various modular units can be provided to increase the size and display space provided by the device. The display modules include a plurality of horizontal divider members removably secured to retainer members. Menu strips, pricing units and display members can be positioned between channels in the divider members and/or the frame members forming the display modules. The pricing units are adapted to be backlit by lights in the display device.

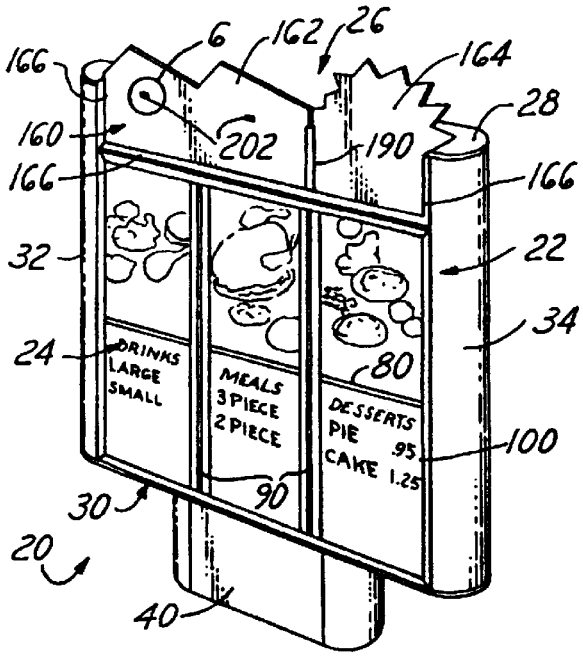

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–11 is confirmed.

New claims 12–29 are added and determined to be patentable.

*12. The display module as set forth in claim 1 wherein each of said pairs of retention members comprise first mating connection members and each of said divider members have second mating connection members thereon, said first and second connection members mating together to secure said divider members to said frame.*

*13. The display module as set forth in claim 1 wherein said frame members lie generally in a first plane and wherein said divider members are positioned on and removed from said frame in a direction generally transverse to said first plane.*

*14. The display module as set forth in claim 1 wherein each of said divider members has at least one rearward extending fastening member which is adopted to be releasably engaged with at least one of said retention members.*

*15. The display module as set forth in claim 1 wherein each of said divider members has a pair of rearwardly extending leg members, said leg members being releasably engageable with at least one of said retention members.*

*16. The display module as set forth in claim 1 wherein said display members are slidably positioned in said channel means.*

*17. The display module as set forth in claim 1 wherein said retention members are disposed at predetermined equally spaced intervals along the length of said first and second opposed frame members.*

*18. The display module as set forth in claim 1 wherein said frame members define a plane and wherein said divider members are selectively positionable at regularly and variably spaced locations vertically along said first and second opposed frame members in a direction substantially transverse to and intersecting said plane.*

*19. The display module as set forth in claim 5 wherein each of said pairs of divider member support members comprise first mating connection members and each of said divider members have second mating connection members thereon, said first and second connection members mating together to secure said divider members to said frame.*

*20. The display module as set forth in claim 5 wherein each of said divider members has at least one rearward extending fastening member which is adopted to be releasably engaged with at least one of said divider member support members.*

*21. The display module as set forth in claim 5 wherein each of said divider members has at least one rearward extending fastening member which is adopted to be releasably engaged with at least one of said divider member support members.*

*22. The display module as set forth in claim 5 wherein said display members are slidably positioned in said channel means.*

*23. The display module as set forth in claim 11 wherein each of said pairs of retention members comprise first mating connection members and each of said divider members have second mating connection members thereon, said first and second connection members mating together to secure said divider members to said frame.*

*24. The display module as set forth in claim 11 wherein said frame assembly members lie generally in a first plane and wherein said divider members are positioned on and removed from said frame in a direction generally transverse to said first plane.*

*25. The display module as set forth in claim 11 wherein each of said divider members has at least one rearward extending fastening member which is adopted to be releasably engaged with at least one of said retention members.*

*26. The display module as set forth in claim 11 wherein each of said divider members has a pair of rearwardly extending leg members, said leg members being releasably engageable with at least one of said retention members.*

*27. The display module as set forth in claim 11 wherein said display members are slidably positioned in said channel means.*

*28. The display module as set forth in claim 11 wherein said retention members are disposed at predetermined equally spaced intervals along the length of said first and second opposed frame members.*

*29. The display module as set forth in claim 11 wherein said frame assembly members define a plane and wherein said divider members are selectively positionable at regularly and variably spaced locations vertically along said first and second opposed frame members in a direction substantially transverse to and intersecting said plane.*

* * * * *